US006847795B2

(12) United States Patent
Hirose et al.

(10) Patent No.: US 6,847,795 B2
(45) Date of Patent: Jan. 25, 2005

(54) IMAGE FORMING APPARATUS

(75) Inventors: Atsuo Hirose, Nagoya (JP); Hidetoshi Yano, Toukai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/443,019

(22) Filed: May 22, 2003

(65) Prior Publication Data

US 2003/0219274 A1 Nov. 27, 2003

(30) Foreign Application Priority Data

May 24, 2002 (JP) ..... 2002-151122

(51) Int. Cl.[7] ..... G03G 21/20
(52) U.S. Cl. ..... 399/92; 399/93
(58) Field of Search ..... 399/91, 92, 93; 355/30; 417/2

(56) References Cited

U.S. PATENT DOCUMENTS 5,647,727 A * 7/1997 Taniguchi et al. ..... 399/92

FOREIGN PATENT DOCUMENTS

JP 1-263668 A * 10/1989
JP 2-311861 A * 12/1990
JP 6-274001 A * 9/1994
JP A 8-211763 8/1996
JP B2 3043575 3/2000
JP A 2001-236001 8/2001
JP 2002-277036 A * 9/2002

* cited by examiner

*Primary Examiner*—Hoan Tran
(74) *Attorney, Agent, or Firm*—Oliff & Berridge, PLC

(57) ABSTRACT

Provided is an image forming apparatus that is capable of reducing noise ascribable to wind noise of fans by performing control of the rotation speed of each cooling fan even during a print process. After power-on at timing T0, when a fixing temperature reaches a waiting temperature (timing T1) or after a print process is finished (timings T3, T6, and T9), a laser printer 1 enters a ready mode and a sub-fan and a power supply fan are driven to rotate at middle speed. From the start of a print process performed for the first time (timing T2), until timing T5 at which a counter X has counted four minutes, each fan is driven to rotate at middle speed during the print process (timings T2 to T3 and T4 to T5). After the, each fan is driven to rotate at high speed (timings T5 to T6 and T8 to T9). Then, when a counter Y has counted a time period set for the ready mode and then a counter Z has counted a time period set for a sleep mode, the counter X is reset. Following this, the counter X restarts counting when a print process is started for the first time after the resetting.

20 Claims, 14 Drawing Sheets

IMAGE FORMING APPARATUS

BACKGROUND OF THE INVENTION

1. Field of the Invention

The present invention relates to an image forming apparatus such as a printer, a copying machine, a facsimile, or a multifunction machine thereof. More specifically, the present invention relates to an image forming apparatus that is capable of performing control of a plurality of fans for cooling the inside of a main body case.

2. Description of the Related Art

In a conventional image forming apparatus such as a laser printer or a copying machine, printing is performed by charging a photosensitive member, subjecting a surface of the photosensitive member to exposure with light from a laser, an LED, and the like to form an electrostatic latent image thereon, developing the electrostatic latent image using a developer such as toner, transferring the developer image visualized onto a recording medium such as paper, and heating and fixing the image with a fixing device. In order to prevent each device constituting the image forming apparatus from being adversely affected by heat emitted from, for instance, the fixing device or a low-voltage power supply unit for supplying driving electric power to each device, the image forming apparatus is provided with a plurality of cooling fans.

In the conventional image forming apparatus, the plurality of fans are driven to rotate at full speed while printing is performed, so that there is a problem in that if a user uses the image forming apparatus in a quiet environment, he/she would be annoyed by noise ascribable to wind noise of the fans.

SUMMARY OF THE INVENTION

The present invention has been made in order to solve the above-mentioned problems, and therefore has an object to provide an image forming apparatus that is capable of reducing noise ascribable to wind noise of fans.

In order to achieve the above-described objectives, an image forming apparatus according to the present invention includes a main body, an image forming unit, a fan, a condition-determining unit, and a fan controller.

The main body case defines therein an inner space.

The image forming unit is disposed in the inner space and performs image forming processes. The image forming unit forms an image on a sheet during each image forming process.

The fan is for cooling the image forming unit. The fan is capable of operating selectively in a first rotation speed, a second rotation speed, and a stopped state. The fan rotates faster in the first rotation speed of the fan than in the second rotation speed of the fan and does not rotate in the stopped state.

The condition-determining unit determines whether a predetermined condition is met.

The fan controller that controls the fan at the second rotation speed when the image forming unit performs an image forming process during a predetermined time period after the condition-determining unit determines that the predetermined condition is met.

According to a second aspect of the present invention, an image forming apparatus includes a main body case, an image forming unit, a fan, a temperature-prediction unit, and a fan controller.

The main body case defines therein an inner space.

The image forming unit is disposed in the inner space and performs image forming processes. The image forming unit forms an image on a sheet during each image forming process.

The fan cools the image forming unit. The fan is capable of operating selectively in a first rotation speed, a second rotation speed, and a stopped state. The fan rotates faster in the first rotation speed of the fan than in the second rotation speed of the fan and does not rotate in the stopped state.

The temperature-prediction unit predicts when a temperature in the inner space of the main body case will be below a predetermined temperature.

The fan controller controls the fan at the second rotation speed while the image forming unit performs an image forming process within a predetermined period of time that begins from start of a first image forming operation after the temperature-prediction unit predicts that the temperature in the inner space of the main body case will be below a predetermined temperature.

According to a third aspect of the present invention, an image forming apparatus includes a main case, an image forming unit, a first fan and a second fan, and a fan controller.

The main case defines therein an inner space.

The image forming unit is disposed in the inner space and performs image forming processes. The image forming unit forms an image on a sheet during each image forming process.

The first fan and the second fan each rotates to cool the image forming unit in the inner space in the main case.

The fan controller selectively drives the first fan and the second to rotate in alternation.

According to a fourth embodiment of the present invention, an image forming apparatus includes a process unit, a fixing unit, a power supply unit, a power supply fan for cooling the power supply unit; a sub-fan, a main fan, a fixing temperature control unit, a fan controller, and a timing judger.

The process unit is for forming a developer image with developer on a sheet.

The fixing unit is for fixing the developer image transferred by the process unit onto the sheet.

The power supply unit is for supplying electric power to the process unit and the fixing unit.

The power supply fan is for cooling the power supply unit.

The sub-fan is for cooling the fixing unit.

The main fan is for cooling the power supply unit, the fixing unit, and the process unit.

The fixing temperature control unit controls temperature of the fixing unit selectively to a first temperature for fixing images and a second temperature that is lower than the first temperature.

The fan controller independently controls a rotation speed of each of the power supply fan, the sub-fan, and the main fan.

The timing judger judges first through fourth timings.

The first timing is when the fixing temperature setting unit sets temperature of the fixing unit to the second temperature. The fan controller controls the sub-fan to rotate and the power supply fan to alternately rotate and not rotate from the first timing.

The second timing is when a first predetermined time period elapses from the first timing. At the second timing, the fan controller stops the main fan while rotating the power supply fan and rotates the main fan while stopping the power supply fan.

The third timing is when a second predetermined time period elapses from the first timing. The fixing temperature control unit turns the fixing unit off from the third timing and The fan controller stops the power supply fan and the main fan from the third timing.

The fourth timing is when a third predetermined time period elapses from the third timing. The fan controller stops the sub-fan from the fourth timing.

DETAILED DESCRIPTION OF THE PREFERRED EMBODIMENTS

Figure 1:
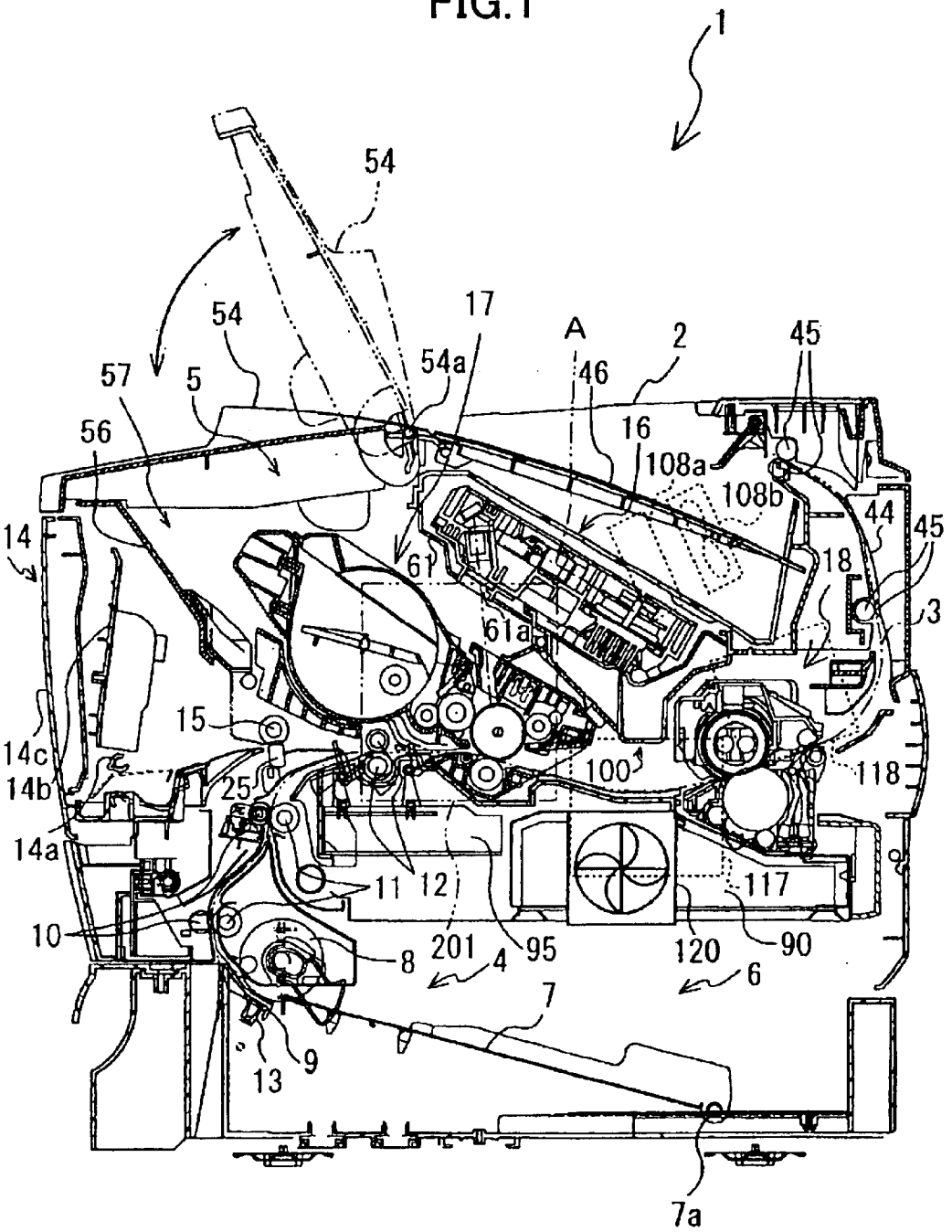
FIG. 1 is a central sectional view of a laser printer of a first embodiment.

Embodiments of an image forming apparatus embodying the present invention will be hereinafter described with reference to the accompanying drawings. First, an overall structure of a laser printer 1 according to a first embodiment will be described with reference to FIG. 1. FIG. 1 is a central sectional view of the laser printer 1 of the embodiment. As shown in FIG. 1, in a sectional view, the laser printer 1 includes a feeder section 4 for feeding a sheet 3 as a recording medium and an image forming section 5 for printing on the fed sheet 3 in a main body case 2. Note that, in the laser printer 1, the left side in the figure is a front surface of the laser printer 1.

A sheet delivery tray 46 is formed in the main case body 2 at a portion close to the rear and on the upper surface, and has a recessed shape such that printed sheets 3 can be stacked and held thereon. In addition, a cartridge receiving section 57 which opens upward is provided in the main body case 2 for inserting a process cartridge 17. An upper surface cover 54 is provide for covering the cartridge receiving section 57 and pivots vertically around a shaft 54*a* provided on a front end side of the sheet delivery tray 46. Note that a position at the time when the upper surface cover 54 is opened is indicated by an alternate long and two short dash lines in the figure.

The image forming section 5 includes a fixing device 18 on a rear end side in a lower part of the main body case 2. In a rear part in the main body case 2 (right side in the figure), a sheet delivery path 44 is provided in a semi-arc in a vertical direction along the back of the main body case 2 such that the sheet 3 delivered from the fixing device 18 is guided to the sheet delivery tray 46. On the sheet delivery path 44, a sheet delivery roller 45 for conveying the sheet 3 is provided.

The feeder section 4 includes: a sheet feed roller 8 which is provided on a bottom part in the main body case 2 and above an end at one side of a sheet feed tray 6 and with which the sheets 3 are brought into contact by a sheet pressing plate 7; the sheet feed tray 6 which is detachably mounted; the sheet pressing plate 7 which is provided in the sheet feed tray 6 and stacks and holds the sheets 3 to bring the sheets 3 into pressed contact with the sheet feed roller 8; a separation pad 9 which is pressed toward the sheet feed roller 8, nips and conveys the sheets 3 in cooperation with the sheet feed roller 8 at the time of sheet feed and feeds the sheets 3 one at a time; conveying rollers 11 which are provided at two positions on a downstream side in a conveying direction of the sheets 3 with respect to the sheet feed roller 8 and perform conveyance of the sheets 3; paper powder removing rollers 10 which come into contact with the respective conveying rollers 11 with the sheet 3 therebetween to remove paper powder and, at the same time, perform conveyance of the sheets 3 in cooperation with the conveying rollers 11; and registration rollers 12 which are provided on a downstream side in the conveying direction of the sheets 3 with respect to the conveying rollers 11 and adjust timing for delivering the sheets 3 at the time of printing.

The sheet pressing plate 7 supports a stack of the sheets 3. A shaft 7*a* is provided at an end on a far side with respect to the sheet feed roller 8. The shaft 7*a* is supported by a bottom surface of the sheet feed tray 6. Therefore, the end of the sheet pressing plate 7 close to the sheet feed roller 8 is movable in the vertical direction with the shaft 7*a* as a pivotal center. In addition, the sheet pressing plate 7 is biased toward the sheet feed roller 8 by a not-shown spring from its back. Thus, the sheet pressing plate 7 is swung downward against a biasing force of the spring with the shaft 7*a* as a fulcrum as a stacked quantity of the sheets 3 increases. The sheet feed roller 8 and the separation pad 9 are disposed so as to be opposed to each other, and the separation pad 9 is pressed toward the sheet feed roller 8 by a spring 13 disposed on the back of the separation pad 9.

In addition, the feeder section 4 includes a hand supply tray 14, a hand supply roller 15, and a separation pad 25. The hand supply tray 14 has a tray portion 14*b* and a cover portion 14*c*. The tray portion 14*b* is provided in a front part of the main body case 2 (left side in the figure), is opened and closed in a front and back direction (left and right direction in the figure) with a shaft 14*a* as a fulcrum, and capable of stacking the sheets 3 when it is open. The cover portion 14*c* is supported by a slide portion (not shown) that can slide with respect to the tray section 14*b* and which becomes a part of the main body case 2 when the tray section 14*b* is closed. The hand supply roller 15 is for feeding the sheets 3 to be stacked on the tray section 14*b* of the hand supply tray 14. The separation pad 25 is for feeding the sheets 3 one at a time.

The hand supply roller 15 and the separation pad 25 are disposed so as to be opposed to each other, and the separation pad 25 is pressed toward the hand supply roller 15 by a spring (not shown) disposed on the back of the separation pad 25. At the time of printing, the sheets 3 to be stacked on the hand supply tray 14 are delivered by the rotating hand supply roller 15 and the separation pad 25, thereby being conveyed to the registration rollers 12 one by one.

Also, a low-voltage power supply unit 90 and a high-voltage power supply unit 95 are provided between the image forming section 5 and the sheet feed tray 6, with the low-voltage power supply unit 90 being arranged below the fixing device 18 and a scanner unit 16 to be described later and the high-voltage power supply unit 95 being arranged below the process cartridge 17. Also, a control board 201 (see FIG. 4) that controls each component of the laser printer 1 is provided between the right-side surface (the side nearest the viewer of FIG. 1) of the main body case 2 and a main body frame (not shown) on the right side. The control board 201 is arranged so that its surface is directed approximately parallel to the right-side surface of the of the main body case 2.

The high-voltage power supply unit 95 is a unit that generates a high-voltage bias to be applied to each portion of the process cartridge 17 to be described later, and a high-voltage power supply circuit board 202 (see FIG. 4) is disposed inside of the high-voltage power supply unit 95. Also, the low-voltage power supply unit 90 is a unit for lowering a single-phase voltage of 100 V supplied from outside of the laser printer 1 to a voltage of 24 V and supplying the lowered voltage to each section in the laser printer 1. A low-voltage power supply circuit board 203 (see FIG. 4) constituting a circuit for realizing this function is arranged at the bottom of the low-voltage power supply unit 90 and its outer periphery is covered with and is protected by an iron plate, for example, formed with left and right sides open.

Also, the main body frame (not shown) on the right side of the low-voltage power supply unit 90 (at the side nearest the viewer of FIG. 1) is provided with a power supply fan 120 for introducing outside air in order to cool the low-voltage power supply unit 90, which generates a great amount of heat while supplying power to other components of the printer 1. Similarly, a main body frame (not shown) on the left side of the low-voltage power supply unit 90 (at the side farthest from the viewer of FIG. 1) is provided with a main fan 117 for exhausting air mainly from the low-voltage power supply unit 90 to the outside of the laser printer 1. Note that the main body frame on the left side (at the side farthest from the viewer of FIG. 1) is also provided with an ozone fan 108*b* and a sub-fan 118, in addition to the main fan 117. The positional relations between the image forming section 5 and these fans will be described later.

Figure 2:
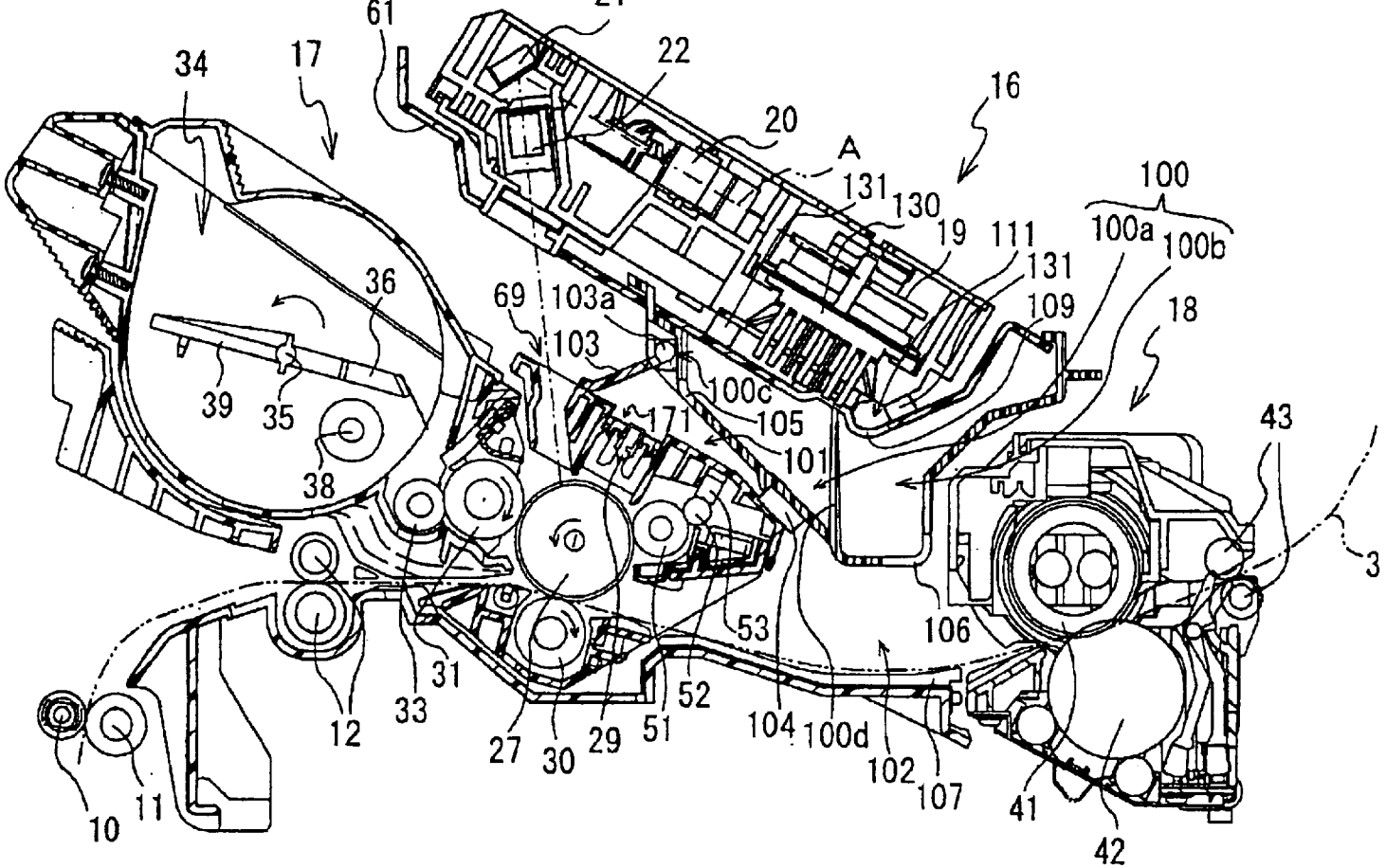
FIG. 2 is a sectional view of an image forming section viewed from a side thereof.
Figure 3:
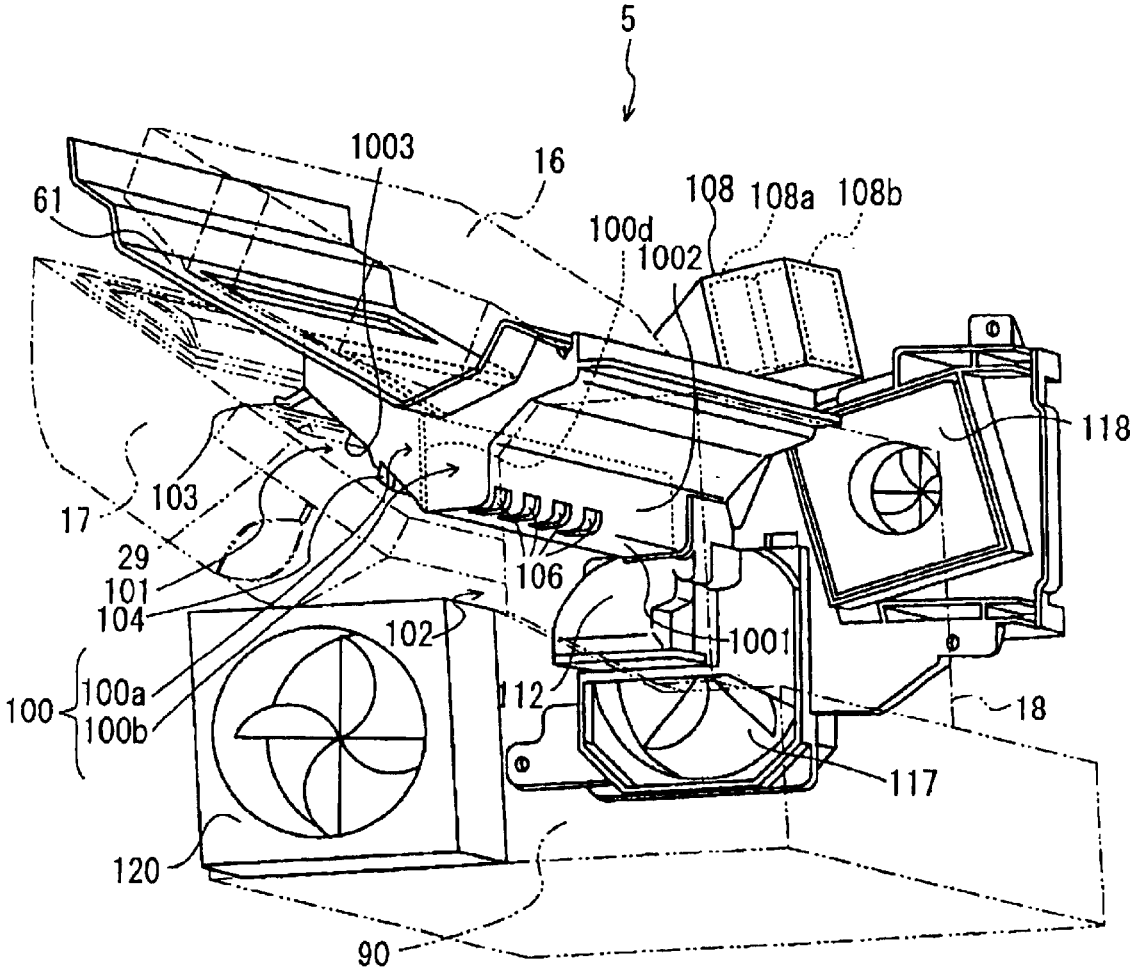
FIG. 3 is a perspective view showing arrangements of fans viewed from the rear in a lower part on a right side of the image forming section and a low-voltage power supply unit.

Next, a structure of the image forming section 5 will be described with reference to FIGS. 2 and 3. FIG. 2 is a sectional view of the image forming section 5 viewed from a side thereof. FIG. 3 is a perspective view showing arrangements of the fans 108*b*, 117, 118, and 120 viewed from the rear in a lower part on a right side of the image forming section 5 and the low-voltage power supply unit 90. The image forming section 5 operates to form an image on the sheet 3 conveyed by the feeder section 4. As shown in FIGS. 2 and 3, the image forming section 5 includes a scanner unit 16, the process cartridge 17, the fixing device 18, and a duct 100.

As shown in FIG. 2, the scanner unit 16 includes: a laser beam emitting section (not shown) which is arranged below the sheet delivery tray 46 in the upper part of the main body case 2 and irradiates a laser beam; a polygon mirror 19 for driving to rotate the laser beam irradiated by the laser beam emitting section and scanning a surface of a photosensitive drum 27 with the laser beam in a main scanning direction; a heat sink 130 for radiating heat generated by the polygon mirror 19; an fθ lens 20 for making a scanning speed of the laser beam used for scanning by the polygon mirror 19 constant; a reflecting mirror 21 for reflecting the laser beam used for scanning; and a relay lens 22 for adjusting a focal position in order to focus the laser beam reflected by the reflecting mirror 21 on the photosensitive drum 27. The scanner 16 causes a laser beam irradiated from the laser beam emitting section based upon print data to pass through or be reflected by the polygon mirror 19, the fθ lens 20, the reflecting mirror 21, and the relay lens 22 in the order as indicated by an alternate long and dash lines A to thereby expose and scan the surface of the photosensitive drum 27 of the process cartridge 17 with the laser beam.

The process cartridge 17 is composed of a drum cartridge and a developing cartridge that is detachably attachable to the drum cartridge. The drum cartridge includes the photosensitive drum 27, a Scorotron charger 29, a transfer roller 30, a cleaning roller 51, a secondary roller 52. On the other hand, the developing cartridge includes a developing roller 31, a supply roller 33, a toner box 34, and the like.

The photosensitive drum 27 is arranged beside the developing roller 31 with a rotation shaft of the photosensitive drum 27 in parallel with a rotation shaft of the developing roller 31 and is rotatably disposed in contact with the developing roller 31 at a position in the counterclockwise direction as indicated by an arrow in FIG. 2. The photosensitive drum 27 is a drum having layers stacked on a conductive base material, such as a charge generation layer, in which an organic photoelectric conductor of azo pigments, phthalocyanine pigments, and the like is dispersed as a charge generation material in binder resin. A charge transfer layer has hydrazone compounds, arylamine compounds, and the like mixed in a resin of polycarbonate and the like. The photosensitive drum 27 is adapted such that, when it is subjected to irradiation of a laser beam, a charge is generated in the charge generation layer by light absorption, the charge is transferred onto the surface of the photosensitive drum 27 through the charge transfer layer to counteract its surface potential charged by the Scorotron charger 29, whereby a potential difference is provided between a part subjected to the irradiation and a part not subjected to the irradiation. By exposing and scanning the surface of the photosensitive drum 27 with a laser beam based upon image data, an electrostatic latent image is formed on the photosensitive drum 27.

The Scorotron charger 29 is disposed above the photosensitive drum 27 a predetermined distance apart therefrom so as not to come into contact with the photosensitive drum 27. The Scorotron charger 29 generates corona discharge from a discharge wire made from tungsten to uniformly charge the surface of the photosensitive drum 27 in a positive polarity. Also, the Scorotron charger 29 is turned on/off by a charging bias circuit portion (not shown) of the high-voltage power supply unit 95. Further, an opening 171 communicating with the outside air is provided on an upper surface of a housing of the process cartridge 17 in a part where the Scorotron charger 29 is provided such that a product such as ozone generated at the time of charging can be discharged to the outside of the process cartridge 17.

In addition, the developing roller 31 is disposed farther downstream than the Scorotron charger 29 with respect to the rotating direction (counterclockwise direction in FIG. 2) of the photosensitive drum 27 and is rotatable clockwise as indicated by an arrow in FIG. 2. The developing roller 31 includes a roller shaft made of metal coated with a roller made of a conductive rubber material. A development bias is applied to the developing roller 31 from a not-shown development bias application power supply of the high-voltage power supply unit 95.

The supply roller 33 is disposed beside the developing roller 31, at a position on the opposite side of the photosensitive drum 27 across the developing roller 31. The supply roller 33 is in pressed contact with the developing roller 31. The supply roller 33 includes a roller shaft made of metal coated with a roller made of a conductive foaming material and is adapted to triboelectrify toner supplied to the developing roller 31.

In addition, the toner box 34 is provided in a position beside the supply roller 33, and is filled with toner to be supplied to the developing roller 31 via the supply roller 33. In the embodiment, a nonmagnetic mono-component toner with a positive charging nature is used as a developer. The toner is polymeric toner obtained by copolymerizing a polymeric monomer, for example, a styrene monomer such as styrene or an acrylic monomer such as acrylic acid, alkyl (C1 to C4) acrylate, or alkyl (C1 to C4) methacrylate using a well-known polymerization method such as suspending polymerization. In such a polymeric toner, a coloring agent such as carbon black and wax are mixed and an externally added agent such as silica is also added in order to improve fluidity. A particle diameter of the polymeric toner is approximately 6 to 10 $\mu$m.

An agitator 36 is supported by a rotation shaft 35 provided in the center of the toner box 34. The agitator 36 rotates counterclockwise as indicated by an arrow in FIG. 2 to agitate the toner in the toner box 34. In addition, a window 38 for detection of a remaining amount of toner is provided in a sidewall of the toner box 34 and is cleaned by a cleaner 39 supported by the rotation shaft 35.

In addition, the transfer roller 30 is disposed downstream from the developing roller 31 in the rotating direction of the photosensitive drum 27 and in a position below the photosensitive drum 27, and is supported rotatable clockwise as indicated by an arrow in FIG. 2. The transfer roller 30 is produced by covering a roller axis made of a metal with a roller made of an ion conductive rubber material, and receives a forward transfer bias applied from a transfer bias circuit portion (not shown) of the high-voltage power supply unit 95 at the time of transferring. Here, the "forward transfer bias" refers to a bias that is applied to the transfer roller 30 so that a potential difference is generated in a direction in which toner electrostatically adhering onto the surface of the photosensitive drum 27 is electrically attracted to the surface of the transfer roller 30.

Next, the cleaning roller 51 is arranged in a position beside the photosensitive drum 27. The arrangement position is equivalent to a position downstream from the transfer roller 30 in the rotating direction of photosensitive drum 27 and a position upstream the Scorotron charger 29. The secondary roller 52 is provided in a position on the opposite side of the photosensitive drum 27 across the cleaning roller 51 so as to come into contact with the cleaning roller 51. Moreover, a slide contact member 53 is in abutment with the secondary roller 52. It should be noted here that to the cleaning roller 51 and the secondary roller 52, a bias is applied from a cleaning bias circuit portion (not shown) of the high-voltage power supply unit 95.

After the toner is transferred onto the sheet 3 from the photosensitive drum 27 by the transfer roller 30, residual toner and paper powder remaining on the surface of the photosensitive drum 27 are electrically attracted by the cleaning roller 51. Then, only the paper powder is electrically attracted by the secondary roller 52 from the cleaning roller 51, and the paper powder attracted by the secondary roller 52 is caught by the slide contact member 53. Then, the bias is switched, so that the toner on the cleaning roller 51 returns to the photosensitive drum 27 and is recovered into the developing cartridge by the developing roller 31. Note that at the time of the cleaning bias switching, a reverse transfer bias is applied from the transfer bias circuit portion (not shown) of the high-voltage power supply unit 95 to the transfer roller 30. Here, the "reverse transfer bias" refers to a bias that is applied to the transfer roller 30 so that a potential difference is generated in a reverse direction with reference to the forward transfer bias, that is, in a direction in which toner is transferred from the surface of the transfer roller 30 to the surface of the photosensitive drum 27.

In addition, an exposure window 69 is provided above the photosensitive drum 27 such that a laser beam from the scanner unit 16 is directly irradiated on the photosensitive drum 27. The exposure window 69 is opened in a portion closer to the toner box 34 than the opening 171 of the Scorotron charger 29 on the upper surface of the housing of the process cartridge 17 such that the photosensitive drum 27 communicates with the outside of the process cartridge 17.

As shown in FIGS. 2 and 3, the fixing device 18 is disposed on a downstream side in a lateral direction of the process cartridge 17 and includes a heating roller 41, a pressing roller 42 for pressing the heating roller 41, and a pair of conveying rollers 43 which is provided on a downstream side of the heating roller 41 and the pressing roller 42. The heating roller 41 is made of metal and includes a halogen lamp 41*a* shown in FIG. 4 for heating inside a tubular roller. The heating roller 41 pressurizes and heats toner transferred onto the sheet 3 in the process cartridge 17 to fix it thereto while the sheet 3 passes between the heating roller 41 and the pressing roller 42, thereafter conveying the sheet 3 to the sheet delivery path 44 by the conveying rollers 43.

In addition, the duct 100, which exhausts air sucked by the fans 108*b* and 117 to be described later to the outside of the main body case 2, is a tubular exhaust passage extended in a width direction (direction perpendicular to an inserting direction) of the process cartridge 17 by a length of the width direction thereof and has a V shape in a side view. The inside of the duct 100 is divided into two chambers by a partition wall 100*d* which divides the width direction vertically in two. A duct 100*a* for exhausting a product such as ozone mainly generated by the Scorotron charger 29 and a duct 100*b* for exhausting air containing heat mainly generated by the fixing device 18 are included in the chambers (see FIG. 5).

Moreover, an exhaust chamber 101 is constituted such that, when the process cartridge 17 is inserted in the main body case 2, the vicinity of the opening 171 provided in the vicinity of the Scorotron charger 29 on the upper surface of the housing of the process cartridge 17 is covered by the shutter 103, a wall surface of the lower part of the duct 100*a*, a partitioning member 104 composed of an elastic member such as rubber or sponge, and left and right side surfaces of the cartridge receiving section 57 to be described later. Further, the exhaust chamber 101 is filled with the ozone generated by the Scorotron charger 29. An opening part 105 is formed in a part opposed to the Scorotron charger 29 on the lower surface of the duct 100*a* such that air containing the ozone is sucked and exhausted to the duct 100*a*.

Note that the partitioning member 104 extends in the width direction (direction perpendicular to the inserting direction) of the process cartridge 17 and the top end part of the partitioning member 104 with respect to the inserting direction of the process cartridge 17 abuts the lower surface of the duct 100*a* when the process cartridge 17 is fully inserted. In addition, the partitioning member 104 also carries out a function as a cushioning material for absorbing shock at the time when the process cartridge 17 is inserted.

In addition, the shutter 103 has a plate shape elongated in the width direction of the process cartridge 17 to a length that is substantially the same as the width of the process cartridge 17. Shafts 103*a* provided at one edge end in a latitudinal direction thereof are supported by supporting portions 100*c* provided on the lower surface of the duct 100*a*. The supporting portions 100*c* are arranged such that, when the shutter 103 is supported, a shaft side of the shutter 103 is on a downstream side of a free end side of the shutter 103 with respect to the inserting direction of the process cartridge 17. In addition, the supporting portions 100*c* support the shutter 103 such that the free end side thereof is movable vertically. When the shutter 103 is closed, the free end thereof is brought into contact with a part between an opening part of the Scorotron charger 29 of the process cartridge 17 and the exposure window 69. Further, the shutter 103 moves in association with opening and closing of the upper surface cover 54 by a not-shown link mechanism, whereby the shutter 103 is opened and closed.

In addition, an opening part 106 is also provided on the lower surface of the duct 100*b*. Air in an exhaust chamber 102, which is constituted by the wall surface of the top end part in the inserting direction of the inserted process cartridge 17, the lower surface of the duct 100*b*, the fixing device 18, and a charge removing plate 107, is exhausted from the opening part 106. Note that the charge removing plate 107 is provided between the process cartridge 17 and the fixing device 18 on the conveying path of the sheet 3 so as to remove charge from the sheet 3, which is charged as it passes through the process cartridge 17 at the time of printing. The charge removing plate 107 has a shape in which a plurality of grooves extend in the conveying direction of the sheet 3 and functions as a sheet guide (see FIG. 5).

Moreover, an opening part 109 is provided on a wall surface in a part of the scanner unit 16 where the heat sink 130 is opposed to an upper surface 61 of the duct 100. The opening part 109 is opened such that both the ducts 100*a* and 100*b* and the scanner unit 16 communicate with each other astride the partition wall 100*d*. The heat sink 130 is exposed to a gap between the scanner unit 16 and the upper surface 61 of the duct 100 from an exposure port opened on a wall surface in the lower part of the scanner unit 16. Further, a sponge 131 is provided so as to cover the exposed heat sink 130 and isolate the gap part from other gap parts. Also, an exhaust chamber 111 is constructed by a portion surrounded by the sponge 131.

Further, as shown in FIG. 3, a connection hole (not shown) is opened in a part on the left side of the scanner unit 16 (inner side in the figure) on the upper surface 61 of the duct 100, and an exhaust pipe 108 communicating with the outside air in the outside of the main body case 2 from the opening part is provided. In a downstream part with respect to an exhaust flow path of the exhaust pipe 108, there are provided the fan 108*b* for sucking air in the exhaust chamber 101 and exhausting the air to the outside of the main body case 2 and the ozone filter 108a for removing ozone contained in the air.

The opening part 106 is formed on a wall surface 1001 constituting a lower most surface in the lower part of the duct 100. The opening part 106 is opened along the wall surface 1001 from a middle position on the lower most surface of the duct 100 to a surface of the duct 100 opposed to the fixing device 18. The wall surface 1001 connects a part 1002 opposed to the fixing device 18 and a part 1003 opposed to the process cartridge 17 of the entire wall surface of the duct 100. The wall surface on which the opening part 106 is opened is a lower part wall surface on the duct 100*b* side of the two ducts 100*a* and 100*b* partitioned by the partition wall 100*d* (see FIG. 2) inside the duct 100. Four opening parts of the opening part 106 are provided in the duct 100*b* at positions close to the right side of the main body case 2 in the width direction of the duct 100*b*.

In addition, in the width direction of the duct 100*b*, the fan 117 for exhaust is provided in the left portion of the main body case 2. The main fan 117 is constructed so that its lower half portion with respect to the rotation axis of its fins is opened to the low-voltage power supply unit 90, thereby exhausting air introduced into the lower-voltage power supply unit 90 by the aforementioned power supply fan 120 and containing heat emitted from the low-voltage power supply circuit board 203 (see FIG. 4). Also, a gap is provided between the main fan 117 and a right-side opened portion (on the side farthest from the viewer of FIG. 1) of the low-voltage power supply unit 90, and air in the exhaust chamber 102 is exhausted to the outside of the laser printer 1 by the main fan 117 through the gap.

In addition, a connection duct 112, which leads from a connection hole (not shown) opened on the opposite side of the opening part 106 in the width direction of the duct 100*b* to the fan 117, is provided in an upper half of the fan 117. The air in the duct 100*b* is discharged to the outside of the main body case 2 from the fan 117 via the connection duct 112.

In addition, the fan 118 is provided in a position in the rear above the fan 117 in the main body case 2. The fan 118 is provided in a position opposed to a side of the fixing device 18 and exhausts heat mainly generated by the fixing device 18. However, no special exhaust chamber is provided, and the fan 118 is adapted to exhaust the air generally from the entire main body case 2.

Figure 4:
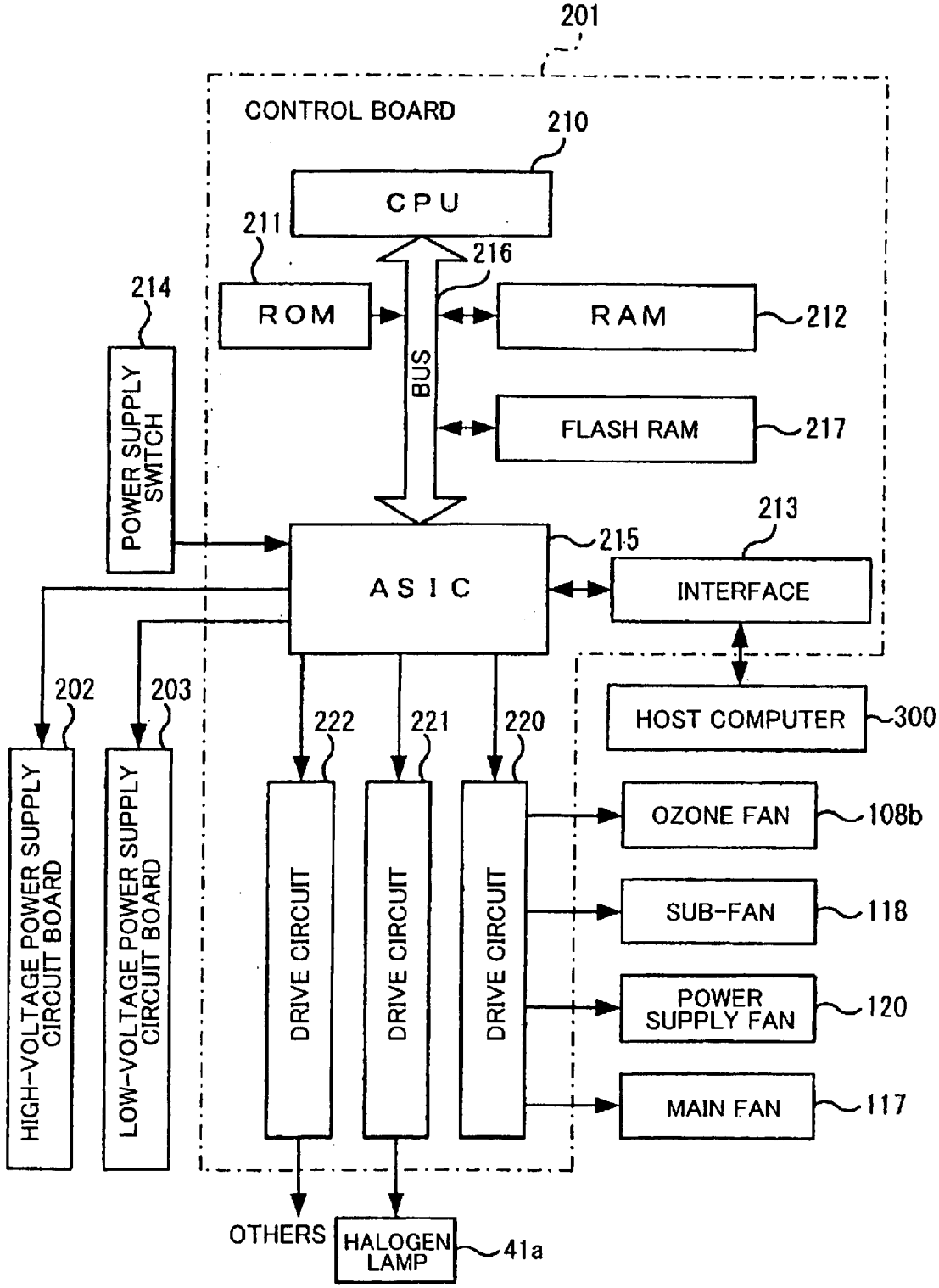
FIG. 4 is a block diagram representing electrical components of the laser printer.
Figure 5:
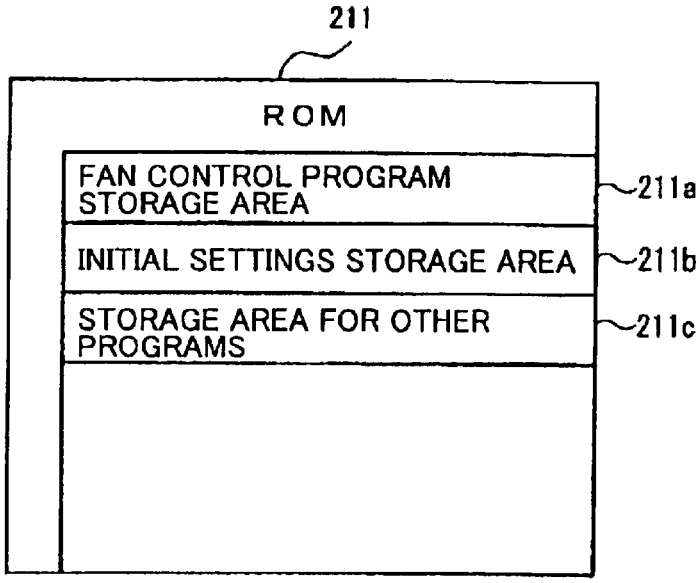
FIG. 5 is a schematic diagram representing storage areas of a ROM.
Figure 6:
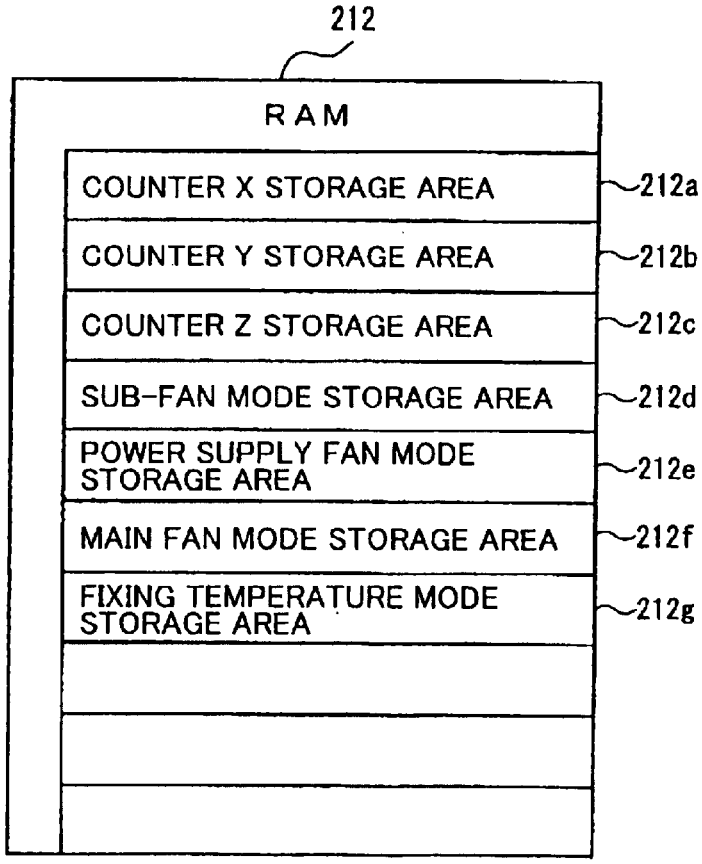
FIG. 6 is a schematic diagram representing storage areas of a RAM.
Figure 7:
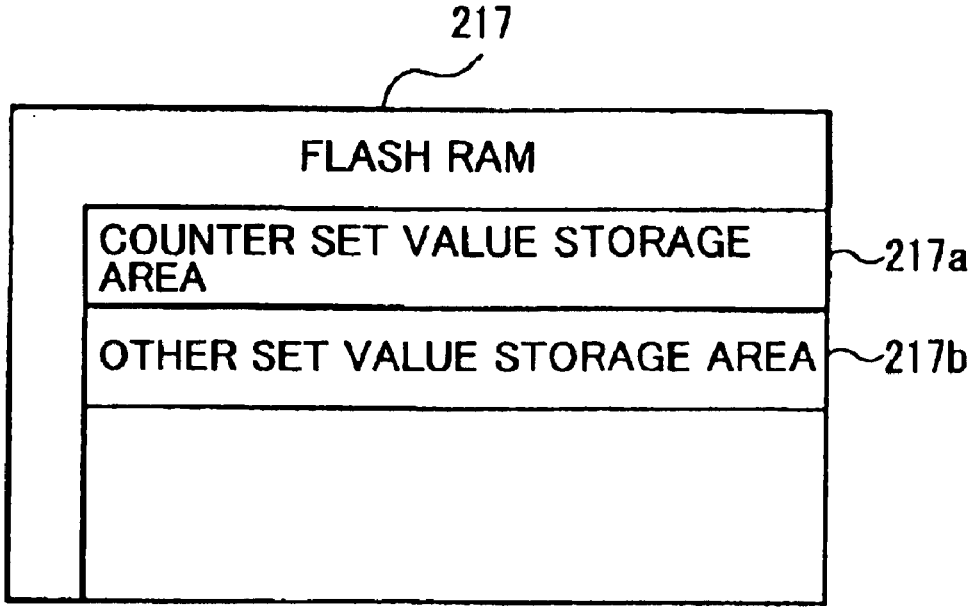
FIG. 7 is a schematic diagram representing storage areas of a flash RAM.

Next, the electrical construction of the laser printer 1 will be described with reference to FIGS. 4 to 6. FIG. 4 is a block diagram showing the electrical construction of the laser printer 1, FIG. 5 is a schematic diagram showing a storage area of a ROM 211, FIG. 6 is a schematic diagram showing a storage area of a RAM 212, and FIG. 7 is a schematic diagram showing a storage area of a flash RAM 217.

As shown in FIG. 4, in the laser printer 1, a CPU 210, the ROM 211, the RAM 212, the flash RAM 217, an ASIC (Application Specific Integrated Circuit) 215, an interface 213, and drive circuits 220, 221, and 222 are provided on the control board 201. To the CPU 210, there are connected the ROM 211, the RAM 212, the flash RAM 217, and the ASIC 215 through a bus 216. Also, to the ASIC 215, there are connected the interface 213 and the drive circuits 220 to 222. The CPU 210 executes various programs and the like stored in the ROM 211. During the execution, the CPU 210 temporarily stores data in the RAM 212 and performs transmission and reception of commands and the like for controlling each device via the ASIC 215 by utilizing values stored in the flash RAM 217. Note that the ASIC is a custom IC constructed so as to be specialized in a specific usage purpose by combining various basic circuits with each other. Such a custom IC is advantageous in that it is possible to realize the main portion of a control circuit of a device with one chip.

Also, to the ASIC 215, there are connected a power supply switch 214 for turning on/off the power supply of the laser printer 1, the high-voltage power supply circuit board 202, and the low-voltage power supply circuit board 203. Further, to the drive circuit 220, there are connected the ozone fan 108*b*, the sub-fan 118, the power supply fan 120, and the main fan 117, and voltage applied to each fan from the drive circuit 220 is controlled by the CPU 210, in order to perform fan control to be described later. Also, a halogen lamp 41*a* of the fixing device 18 is connected to the drive circuit 221. Voltage applied to the halogen lamp 41*a* by the drive circuit 221 is controlled to control the fixing temperature of the fixing device 18 to an image fixing temperature, a waiting temperature, and off. Also, to the drive circuit 222, there are connected other devices such as a motor and a display panel (not shown).

Also, a host computer 300 connected to the interface 213 of the control board 201 is capable of transmitting print data and the like to the laser printer 1.

Next, as shown in FIG. 5, the ROM 211 is provided with a fan control program storage area 211*a* to be described later in which there is stored a program to be executed by the CPU 210 in order to control the rotation speed of each of the ozone fan 108*b*, the sub-fan 118, the power supply fan 120, and the main fan 117. The ROM 211 is also provided with an initial setting storage area 211*b* in which various kinds of initial set values are stored, and another program storage area 211*c* in which there are stored various other programs to be executed by the CPU 210 in order to control the laser printer 1.

Also, as shown in FIG. 6, the RAM 212 is provided with a counter X storage area 212*a*, a counter Y storage area 212*b*, a counter Z storage area 212*c*, a sub-fan mode storage area 212*d*, a power supply fan mode storage area 212*e*, a main fan mode storage area 212*f*, a fixing temperature mode storage area 212*g*, and the like. In each of the counter X storage area 212*a*, the counter Y storage area 212*b*, and the counter Z storage area 212*c*, there is stored a count value of corresponding one of counters X, Y, and Z. Also, in each of the sub-fan mode storage area 212*d*, the power supply fan mode storage area 212*e*, and the main fan mode storage area 212*f*, there is stored a value ("0", "1", or "2") of corresponding one of variables SF, PF, and MF. The values of these variables are referred to when the fan control program to be described later is executed, during which the control of each fan is performed. That is, a driving voltage is applied from the drive circuit 220 (see FIG. 4) to a fan so that the fan is stopped when its corresponding variable value is "0", is driven to rotate at middle speed when the variable value is "1", and is driven to rotate at high speed when the variable value is "2". Note that a state where a fan is driven to rotate at middle speed is referred to as a "slow rotation speed", while a state where the fan is driven to rotate at high speed is referred to as a "fast rotation speed".

It should be noted here that a voltage of 24 V is applied from the drive circuit 220 to the sub-fan 118, the power supply fan 120, and the main fan 117 when these fans are to rotate at high speed. On the other hand, a voltage of 12 V is applied to the sub-fan 118 and the power supply fan 120 and a voltage of 16 V is applied to the main fan 117 when these fans are to rotate at middle speed.

Also, one of values "0", "1", and "2" is stored as a variable Fu stored in the fixing temperature mode storage area 212*g*. If the variable value in the fixing temperature mode storage area 212*g* is "0" then the drive circuit 221 (see FIG. 4) applies a voltage to the halogen lamp 41*a* of the fixing device 18 so that the fixing device 18 is not driven (i.e., is turned off to cool to room temperature). If the variable value is "1", then the drive circuit 221 applies a voltage so that the halogen lamp 41*a* is heated to a waiting temperature (around 160° C.). If the variable value is "2", then the drive circuit 221 applies a voltage so that the halogen lamp 41*a* is heated to a printing temperature (around 200° C.).

Further, as shown in FIG. 7, the flash RAM 217 is provided with a counter set value storage area 217*a* and another set value storage area 217*b*. The flash RAM 217 holds its storage contents even when the laser printer 1 is turned off. Note that when the storage contents of the flash RAM 217 are initialized, each value stored in the initial setting storage area 211*b* of the ROM 211 is stored in corresponding one of a counter set value storage area 217*a* and the other set value storage area 217*b*. Also, in the counter set value storage area 217*a*, there is stored a value inputted in advance by a user using an input panel (not shown) that indicates a time period during which a ready mode (to be described later) is to be continued. A value "20 minutes" is stored in the initial setting storage area 211*b* as an initial value and the user then selects an optional time period in the range of from 1 to 40 minutes.

Next, there will be described each of the counters. The counters X, Y, and Z are each a counter for measuring an elapsed time in order to make judgment on a predetermined condition during one of the modes of the laser printer 1. That is, the counter X is used during a print mode in which printing is performed, the counter Y is used during a ready mode in which there is waited for reception of print data, and the counter Z is used during a sleep mode in which there is waited for reception of print data under a state where preheating of the fixing device 18 is turned off.

The print mode counter X starts counting from "0" when print data is received the first time after the laser printer 1 is turned on or the counter Z reaches a predetermined value (1200 in the present embodiment) during the sleep mode. The print mode-counter X is incremented by one each time one second elapses. Also, once started counting, the counter X will not be cleared to "0" unless the counter Z reaches the predetermined value during the sleep mode. Note that while printing is performed, the laser printer 1 is set in the print mode, during which the temperature of the fixing device 18 is maintained at the printing (image fixing) temperature.

The ready mode counter Y starts counting from "0" each time the temperature of the fixing device 18 reaches the waiting temperature without receiving print data after the laser printer 1 is turned on a print process by the laser printer 1 is finished. During counting, the ready mode counter Y is incremented by one each time one second elapses. The ready mode counter Y is cleared to "0" either once a print process that started during the counting operation is finished or when the counter Z reaches the predetermined number (1200)

during the sleep mode. Note that the laser printer 1 enters the ready mode when the ready mode counter Y starts counting, and exits the ready mode either when print data is received or when the counter Y exceeds the set value that is stored in the counter set value storage area 217*a* of the flash RAM 217. The set value indicates the duration of the ready mode. During the ready mode, the temperature of the fixing device 18 is maintained at the waiting temperature.

The sleep mode counter Z starts counting when the count value of the ready mode counter Y exceeds the set value, and is incremented by one each time one second elapses. The sleep mode counter Z is cleared to "0" each time the count value of the sleep mode counter Z exceeds the predetermined value of "1200" or after a print process that started during the counting operation of the sleep mode counter Z is finished. Note that the laser printer 1 enters the sleep mode at the time that the counter Z starts counting. The sleep mode is continued even after the counter Z reaches the predetermined value of "1200", and ends when print data is received. During the sleep mode, no voltage is applied to the halogen lamp 41*a* of the fixing device 18, that is, the halogen lamp 41*a* is turned off.

Next, the printing operation of the laser printer 1 will be described with reference to FIGS. 1, 2, and 4. A top sheet 3 among sheets stacked on the sheet pressing plate 7 of the sheet feed tray 6 is pressed toward the sheet feed roller 8 from the underside of the sheet pressing plate 7 by a spring (not shown). When printing is started based on reception of print data from the host computer 300, the sheet 3 is delivered by a frictional force with the rotating sheet feed roller 8 and is nipped between the sheet feed roller 8 and the separation pad 9. The sheet 3 is separated from the stack and sent to the registration roller 12 by an opposing conveying roller 11 after paper powder adhering onto the surface of the sheet 3 is removed by the paper powder removing roller 10.

On the other hand, in the scanner unit 16, laser light generated by the laser beam emitting section (not shown) based on a laser drive signal generated by an engine controller (not shown) is emitted toward the polygon mirror 19. The polygon mirror 19 scans the incident laser light in the main scanning direction (direction orthogonal to a direction in which the sheet 3 is conveyed), thereby emitting the laser light toward the fθ lens 20. The fθ lens 20 converts the laser light scanned by the polygon mirror 19 at an equiangular speed into constant speed scanning light. Then, the laser light is reflected by a reflecting mirror 21, is converged by the relay lens 22, and forms an image on the surface of the photosensitive drum 27.

The photosensitive drum 27 is charged by the Scorotron charger 29 so that its surface potential becomes around 1000 V, for instance. As the photosensitive drum 27 rotates in the counterclockwise direction as indicated by an arrow in FIG. 2, the photosensitive drum 27 is next irradiated with the laser light. The laser light is emitted to irradiate the photosensitive drum 27 at portions that correspond to portions of the sheet 3 to be developed and not irradiated at portions that correspond to portions of the sheet 3 that are not to be developed in the main scanning direction of the sheet 3. The surface potential of portions that are irradiated with the laser light are referred to as bright portions. The potential at the bright portions drop to around 100 V, for instance, from the irradiation of the laser light. Then, as a result of rotation of the photosensitive drum 27, the laser light is also irradiated in the auxiliary scanning direction (direction in which the sheet 3 is conveyed). As a result, an electrical invisible image, that is, an electrostatic latent image is formed on the surface of the photosensitive drum 27 by the bright portions and the portions not irradiated with the laser light. The non irradiated portions are also referred to as dark portions.

Also, toner in the toner box 34 is supplied to the developing roller 31 through rotation of the supply roller 33. At this time, the toner is positively charged by friction between the supply roller 33 and the developing roller 31, is regulated to a thin layer having a constant thickness, and is borne on the developing roller 31. To the developing roller 31, there is applied a positive bias of around 300 to 400 V, for instance. When opposing and contacting the photosensitive drum 27 as a result of rotation of the developing roller 31, the positively charged toner borne on the developing roller 31 is transferred onto the electrostatic latent image formed on the surface of the photosensitive drum 27. That is, the potential of the developing roller 31 is lower than the potential (+1000 V) in the dark portions and is higher than the potential (+100 V) in the bright portions, so that the toner is selectively transferred to the bright portions, which have the lower potential. In this manner, developing is performed and a visible developer image is formed by the toner on the surface of the photosensitive drum 27.

The registration rollers 12 perform registration of the sheet 3 and deliver the sheet 3 at a timing at which the leading end of the visible image formed on the surface of the rotating photosensitive drum 27 coincides with the leading end of the sheet 3. Then, while the sheet 3 passes between the photosensitive drum 27 and the transfer roller 30, a negative bias (around −200 V, for instance) that is further lower than the potential (+100 V) in the bright portions is applied to the transfer roller 30, thereby transferring the visible image formed on the surface of the photosensitive drum 27 onto the sheet 3.

Then, the sheet 3 having the toner transferred thereon is conveyed to the fixing device 18. While passing therethrough, the toner and the residual charge is removed from the sheet 3 by the charge removing plate 107, which is grounded. Then, the heating roller 41 applies heat of around 200° C. and the pressing roller 42 applies pressure to the sheet 3 on which the toner image clings, thereby melting and fixing the toner borne on the sheet 3 and forming a permanent image. Note that the heating roller 41 and the pressing roller 42 are connected to ground through a diode and the pressing roller 42 has a lower surface potential than the heating roller 41. Therefore, the positively charged toner on the surface of the sheet 3 that faces the heating roller 41 is electrically attracted to the pressing roller 42 through the sheet 3. This prevents the toner image from being disturbed by attraction to the heating roller 41 during fixing.

The sheet 3 having the toner fixed thereon through the pressing and heating is conveyed on the sheet delivery path 44 by the sheet delivery roller 45 and is delivered onto the sheet delivery tray 46 so that its print surface faces down. Similarly, a sheet 3 subjected to printing next is stacked on the sheet 3 previously delivered to the sheet delivery tray 46 so that its print surface faces down. As a result, the user is capable of obtaining sheets 3 that are stacked in a desired print order.

Figure 8:
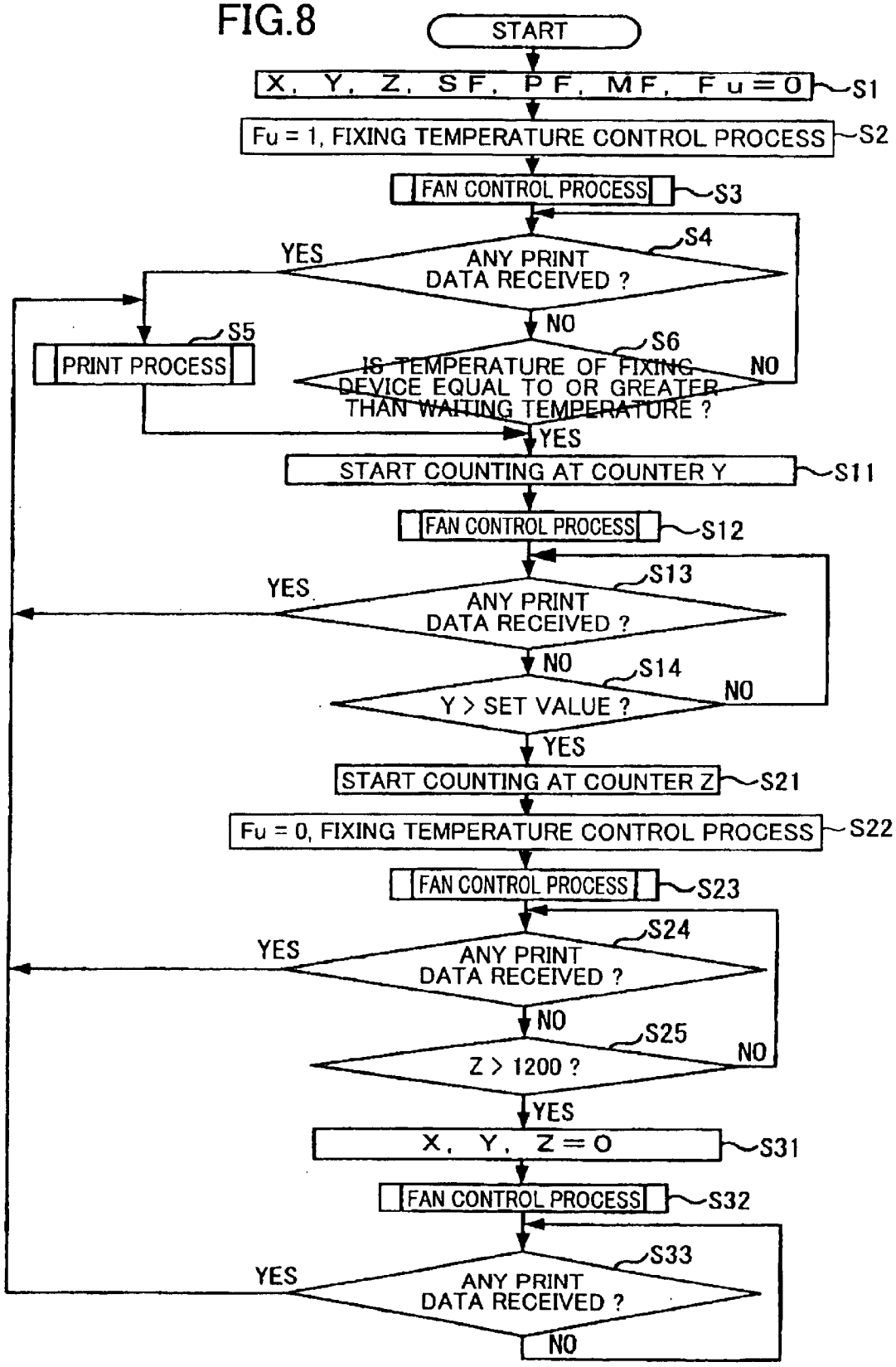
FIG. 8 is a flowchart representing a fan control main routine.
Figure 9:
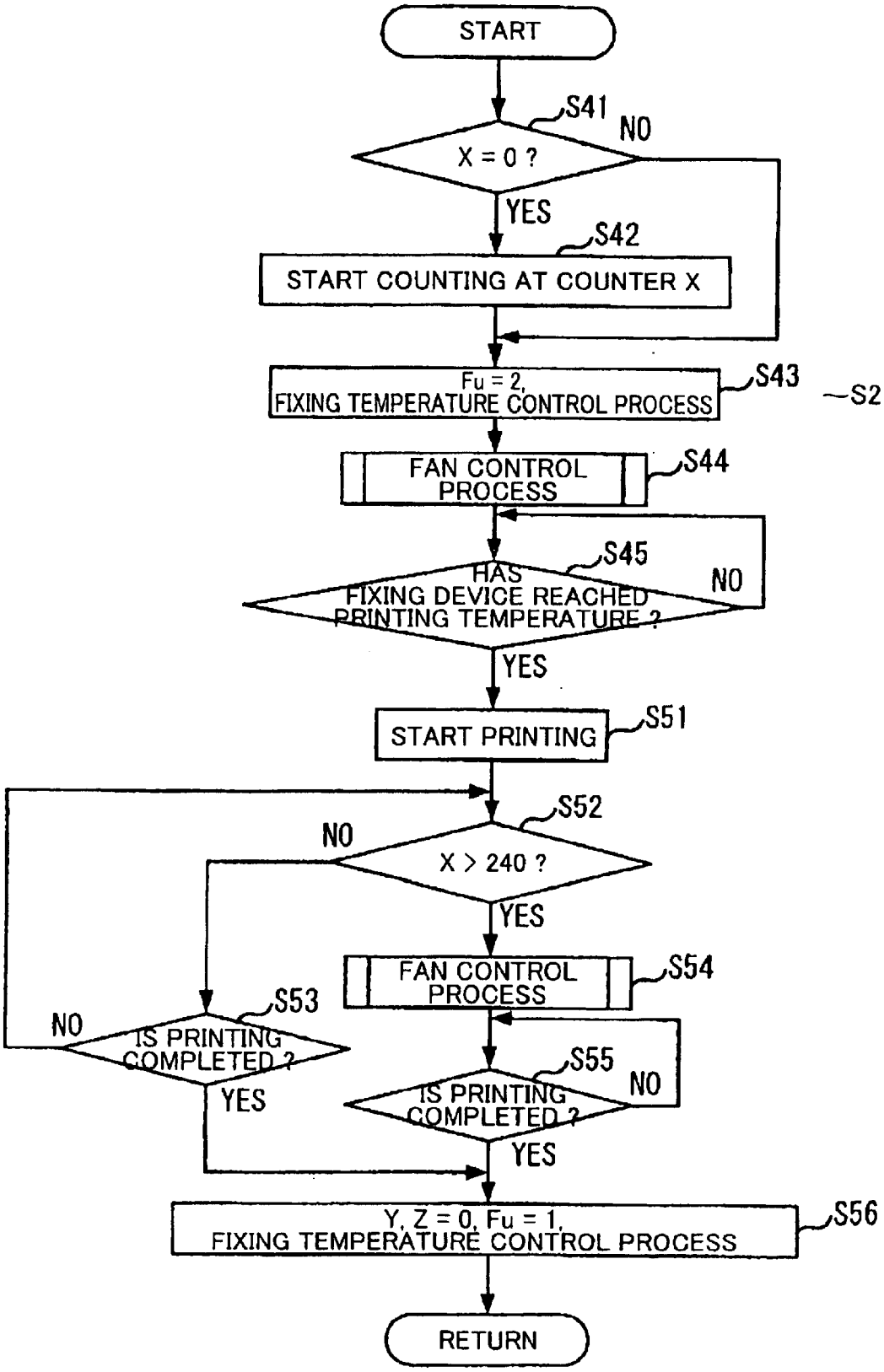
FIG. 9 is a flowchart representing a print process subroutine.
Figure 10:
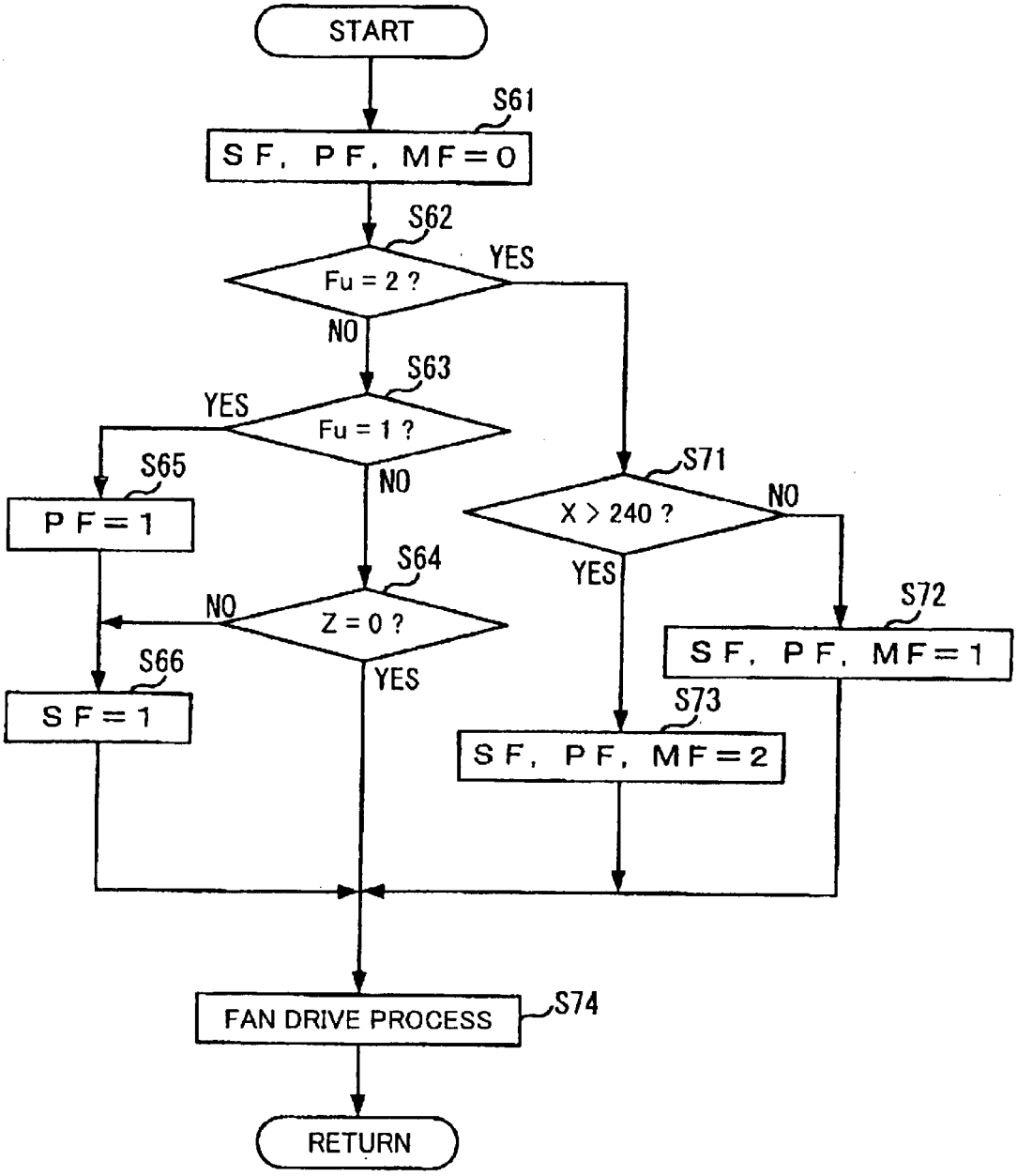
FIG. 10 is a flowchart representing a fan control process subroutine.

Next, the control of the main fan 117, the sub-fan 118, and the power supply fan 120 in the laser printer 1 will be described by following the flowcharts shown in FIGS. 8 to 10 with reference to FIGS. 4 to 7. FIG. 8 is a flowchart of a fan control main routine, FIG. 9 is a flowchart of a print process subroutine, and FIG. 10 is a flowchart of a fan control process subroutine. Steps in these flowcharts will be hereinafter abbreviated to "S" before the number of the step. Note that the ozone fan 108*b* is driven to rotate at high speed when the main fan 117 is in operation, and is stopped when the main fan 117 is not in operation.

It should be noted here that in the flowcharts in the embodiment to be described below, the passage of each preset and predetermined time period is measured using one of the counters X, Y, and Z, and the fan control is performed using the measured elapsed time as a judgment condition. The predetermined time periods for driving each fan in order to prevent the occurrence of influence of heat on the process cartridge 17, the low-voltage power supply unit 90, and the like of the laser printer 1 are calculated in advance, for example through experiments. For example, the time period wherein heat in the main casing can be predicted to exceed a predetermined temperature is determined to prevent the process cartridge 17 and other components from being influenced by heat. For example, if the process cartridge 17 is influenced by heat, the toner contained therein melts due to the heat and therefore the quality of the image formed on the sheet 3 is lowered. Also, if the temperature of the cleaning roller 51 rises due to the heat, the toner electrically attracted onto the cleaning roller 51 melts and adheres to the cleaning roller 51 and therefore the cleaning performance of the cleaning roller 51 changes. Further, if the heat influences the low-voltage power supply unit 90, then elements arranged on the low-voltage power supply circuit board 203 can be thermally damaged or the temperature of the low-voltage power supply circuit board 203 can exceed the allowable temperature range determined for the element by specifications. Here, a state where "no influence is exerted by heat" refers to a state where temperatures at certain portions of the process cartridge 17 and the low-voltage power supply circuit board 203 are maintained within a predetermined temperature range so that the situations described above are prevented from occurring.

The fan control represented by the flowcharts in FIGS. 8 to 10 is performed by the CPU 210 executing the program stored in the fan control program storage area 211*a* of the ROM 211. The program is started when the laser printer 1 is turned on or when the laser printer 1 is reset.

As shown in FIG. 8, when the fan control program is started, the CPU 210 first sets values X, Y, Z. SF, PF, MF, Fu to "0" (S1). That is, "0" is stored in each of the counter X storage area 212*a*, the counter Y storage area 212*b*, the counter Z storage area 212*c*, the sub-fan mode storage area 212*d*, the power supply fan mode storage area 212*e*, the main fan mode storage area 212*f*, and the fixing temperature mode storage area 212*g* of the RAM 212. Next, the CPU 210 sets the value Fu to "1" and performs a fixing temperature control process (S2). That is, "1" is stored in the fixing temperature mode storage area 212*g* and a voltage is applied from the drive circuit 221 to the halogen lamp 41*a* so that the heating roller 41 of the fixing device 18 is heated to the waiting temperature.

Next, the CPU 210 executes the fan control process subroutine (S3) represented by the flowchart shown in FIG. 10. As shown in FIG. 10, when the fan control process subroutine is started, the CPU 210 sets the values SF, PF, MF to "0" (S61), so that "0" is stored in each of the sub-fan mode storage area 212*d*, the power supply fan mode storage area 212*e*, and the main fan mode storage area 212*f* of the RAM 212. As a result, an initial operation value for each fan is set so that operation of each fan can be based on various conditions during the fan control process.

Next, the CPU 210 confirms whether Fu is set at "2" by referring to the value in the fixing temperature mode storage area 212*g* of the RAM 212 (S62). At this point in time in this example, Fu is set at "1" as a result of the operation in S2 in FIG. 8 (S62: NO), so that the process proceeds to S63, in which it is confirmed whether Fu is set at "1" (S63). Because Fu is set at "1" in this example (S63: YES), PF is set at "1" (S65) and then SF is set at "1" (S66), so that "1" is stored in each of the power supply fan mode storage area 212*e* and the sub-fan mode storage area 212*d* of the RAM 212.

Next, the CPU 210 performs a "fan drive process" (S74) by referring to the value in each of the sub-fan mode storage area 212*d*, the power supply fan mode storage area 212*e*, and the main fan mode storage area 212*f* of the RAM 212. In this example, MF was set at "0" in S61, PF was set at "1" in S65, and SF was set at "1" in S66, so the CPU 210 transmits a control signal indicating these variable values to the drive circuit 220. The drive circuit 220 applies a drive voltage to each fan based on the control signal so that the sub-fan 118 is driven to rotate at middle speed, the power supply fan 120 is driven to rotate at middle speed, and the main fan 117 is not driven (stopped). Then, the fan control process is ended and the process returns to the fan control main routine shown in FIG. 8.

It should be noted here that when an image forming process is being performed, the value in the fixing temperature mode storage area 212*g* of the RAM 212 referred to by the CPU 210 will be "2" during the judgment operation in S62 (S62: YES). In this case, the CPU 210 judges whether X is greater than "240" by referring to the value in the counter X storage area 212*a* of the RAM 212 (S71). When the count value of the counter X is greater than "240" (S71: YES), this means that it can be predicted that various temperatures in the main casing, such as at the process cartridge 17 from heat from the fixing device 18 and temperature at the power supply units 90 and 95 from the power supply units 90 and 95, may be too high so the process proceeds to S73, in which the CPU 210 sets SF, PF, and MF to "2" (S73). As a result, "2" is stored in each of the sub-fan mode storage area 212*d*, the power supply fan mode storage area 212*e*, and the main fan mode storage area 212*f* of the RAM 212. Then, the fan drive process is performed in S74, this time resulting in the sub-fan 118, the power supply fan 120, and the main fan 117 each being driven to rotate at high speed (S74). When the fan control process is ended, the process returns to the fan control main routine shown in FIG. 8.

Further, when it is found in S71 that the count value of the counter X is equal to or smaller than "240" (S71: NO), this means that the temperature in the main casing are high enough to influence the components therein so the CPU 210 sets the values SF, PF, and MF to "1" (S72), so that "1" is stored in each of the sub-fan mode storage area 212*d*, the power supply fan mode storage area 212*e*, and the main fan mode storage area 212*f* of the RAM 212. Then, the fan drive process is performed in S74, this time resulting in the sub-fan 118, the power supply fan 120, and the main fan 117 each being driven to rotate at middle speed (S74). When the fan control process is ended, the process returns to the fan control main routine shown in FIG. 8.

Also, when the CPU 210 judges in S63 that the value in the fixing temperature mode storage area 212*g* of the RAM 212 is "0" (S63: NO), the CPU 210 then confirms whether Z is set at "0" (S64). As described above, the CPU 210 starts the counter Z when the laser printer 1 enters the sleep mode. As will be described later, the counter Z will be reset to "0" in S25 and S31 in FIG. 8 once 1200 seconds (20 minutes) elapse from the start of counting by the counter Z, whereupon the counter Z registers the predetermined value of 1200. Therefore, if the judgment operation in S64 is performed before 1200 seconds have elapsed from the start of the sleep mode of the laser printer 1 then the counter Z will not yet be reset to "0" (S64: NO), so the process proceeds to S66 and then to the fan drive process of S74, whereupon the sub-fan 118 is driven to rotate at middle speed because SF was set to "1" in S66 and the power supply fan 120 and the main fan 117 are not driven (stopped) because PF and MF were set to "0" in S61. On the other hand, if the judgment operation in S64 is performed after 1200 seconds have elapsed from the start of the sleep mode, which means that the counter Z will have been reset to "0" (S64: YES), the process proceeds to the fan drive process of S74, where the sub-fan 118, the power supply fan 120, and the main fan 117 are all stopped (S74). Then, the fan control process of S74 is ended and the process returns to the fan control main routine shown in FIG. 8.

As shown in FIG. 8, after returning from the fan control process subroutine of S3, the CPU 210 confirms whether print data has been received (S4). When the user transmits print data from the host computer 300 in order to perform printing by the laser printer 1, the print data is transmitted to the ASIC 215 through the interface 213 in the laser printer 1. Therefore, the CPU 210 confirms whether the ASIC 215 has received print data in S4. When no print data has been received by the ASIC 215 (S4: NO), the CPU 210 confirms whether the temperature of the halogen lamp 41*a*, which was applied with voltage from S2, has reached the waiting temperature. That is, the CPU 210 refers to a temperature sensor (not shown) to determine whether the temperature of the fixing device is at least equal to the waiting temperature (S6). Then, when the fixing device has not yet reached the waiting temperature (S6: NO), the process returns to the operation in S4.

When the CPU 210 judges in S4 that the ASIC 215 has received print data (S4: YES), a "print process" subroutine represented by the flowchart shown in FIG. 9 is executed (S5). During the print process, the laser printer 1 is set in the print mode.

As shown in FIG. 9, when the print process subroutine is started, the CPU 210 confirms whether X is set at "0" by referring to the value in the counter X storage area 212*a* of the RAM 212 (S41). If the count value of the counter X is "0" (S41: YES), the CPU 210 instructs the counter X to start counting (S42). If the counter X has already started counting (S41: NO), the process proceeds to S43 while allowing the counter X to continue the counting.

Then, the CPU 210 sets the Fu at "2" and performs the fixing temperature control process (S43). That is, "2" is stored in the fixing temperature mode storage area 212*g* and a voltage is applied from the drive circuit 221 to the halogen lamp 41*a* so that the heating roller 41 of the fixing device 18 is heated to the printing temperature.

Next, the CPU 210 executes the "fan control process" subroutine (S44), thereby performing the process in the flowchart shown in FIG. 10 in the same manner as above. When the print process is started for the first time after the power is turned on or after the count value of the counter X is reset to "0" (S41:YES), then the fan control process subroutine of FIG. 10 will be executed immediately after the counter X is started counting from "0" in S42. Accordingly, the count value of the counter X will be judged in S71 to be equal to or smaller than "240". Therefore, the process of S72 is performed before the fan drive process in S74, so that during the fan drive process the sub-fan 118, the power supply fan 120, and the main fan 117 are each driven to rotate at middle speed.

Then, the process returns from the print process in S44 of FIG. 9, whereupon it is confirmed using the temperature sensor (not shown) whether the temperature of the fixing device has reached the printing temperature (S45). The CPU 210 refrains from advancing the process before the temperature of the fixing device 18 reaches the printing temperature (S45: NO). However, once the printing temperature is reached (S45: YES), the CPU 210 starts printing (S51).

The counter X continues counting even while waiting for the fixing device to reach the printing temperature in S45. After printing starts, the CPU 210 confirms whether "X" is greater than "240" (S52). If the count value of the counter X is equal to or smaller than "240", the process proceeds to S53 (S52: NO), whereupon the CPU 210 confirms whether printing is finished (S53). When printing is not yet finished (S53: NO), the process returns to S52, whereupon the count value of the counter X is checked. As long as printing is performed while the count value of the counter X is equal to or smaller than "240", then the operations in S52 and S53 are alternately performed, but the fan control is not performed.

When the count value of the counter X exceeds "240" (S52: YES), the CPU 210 executes the "fan control process" subroutine (S54) represented by the flowchart shown in FIG. 10. At this time, the operations in S61, S62, and S71 are performed in this order because the fan control process of FIG. 10 is being performed while printing is being performed. The process proceeds to S73 as a result of the judgment operation in S71. Consequently, SF, PF, and MF are all set to "2" and then the fan drive process in S74 is performed. Accordingly, if a print process is being performed when 240 seconds (four minutes) have elapsed from when the counter X starts counting (that is, from when a print process is started for the first time after power-on or after the count value of the counter X is reset to "0"), the sub-fan 118, the power supply fan 120, and the main fan 117 are each driven to rotate at high speed.

When the execution of the fan control process subroutine in S54 is ended, then as shown in FIG. 9 the CPU 210 confirms whether printing is finished (S55). When printing is not yet finished (S55: NO), the CPU 210 waits for the printing to be finished. Then, once printing is finished (S55: YES), the CPU 210 sets the values Y and Z to "0", the value Fu to "1", and performs the fixing temperature control process (S56). That is, "0" is stored in the counter Y storage area 212*b* and the counter Z storage area 212*c* of the RAM 212 and "1" is stored in the fixing temperature mode storage area 212*g*. Therefore, a voltage is applied from the drive circuit 221 to the halogen lamp 41*a* so that the heating roller 41 of the fixing device 18 is heated to the waiting temperature. Thereafter, the process returns to the fan control main routine shown in FIG. 8. Note that it is judged in S53 and S55 that printing is finished once the sheet 3, or the final sheet in a series of sheets of a print job, is delivered to the sheet delivery tray 46 and the driving of the photosensitive drum 27 and the sheet delivery roller 45 is stopped.

The CPU 210 instructs the counter Y to start counting (S11) when it is found in S6 in FIG. 8 that the temperature of the fixing device 18 is equal to or greater than the waiting temperature (S6: YES) or when the print process subroutine in S5 ends. That is, the ready mode is started. During the ready mode, the CPU 210 waits for reception of print data while the fixing device 18 is maintained at the waiting temperature. Then, the CPU 210 executes the "fan control process" subroutine (S12) represented by the flowchart shown in FIG. 10 to set the rotation speed of each fan as suited for the ready mode, that is, to set the rotation speed of the sub-fan 118 and the power supply fan 120 to rotate at middle speed and to stop the main fan 117. Printing is not being performed at this time so the value Fu is set to "1". Therefore, the operations in S61, S62, S63, S64, S65, and S66 in the fan control process subroutine in FIG. 10 are performed in this order. As a result, SF and PF are each set at "1" and MF is set at "0". Then, the fan drive process of S74 is performed, so that the sub-fan 118 and the power supply fan 120 are each driven to rotate at middle speed and the main fan 117 is stopped.

Next, after returning to the fan control main routine shown in FIG. 8, the CPU 210 confirms whether print data has been received (S13). Similarly to the operation in S4 described above, the CPU 210 confirms whether the ASIC 215 has received print data. When no print data has been received by the ASIC 215 (S13: NO), the CPU 210 then confirms whether Y is greater than the set value (S14) that indicates the duration of the ready mode. That is, the CPU 210 compares the set value stored in the counter set value storage area 217*a* with the value in the counter Y storage area 212*b* of the RAM 212 and, when the count value of the counter Y is equal to or smaller than the set value (S14: NO), this means that the ready mode has not continued long enough to enter the printer into the sleep mode, so the process returns to S13, thereby repeating the judgment operations in S13 and S14.

Here, when the CPU 210 detects as a result of the operation in S13 that the ASIC 215 has received print data (S13: YES), the CPU 210 executes the print process subroutine in S5. Then, the process represented in the flowchart of FIG. 9 is performed, so that the laser printer 1 enters the print mode and printing is started. As described above, the count value of the counter Y is reset to "0" by the operation in S56 prior to the ending of the print process subroutine. Then, the process returns to the fan control main routine shown in FIG. 8 and the operations in S11 and the succeeding steps are performed. That is, the laser printer 1 again enters the ready mode after printing is finished.

When it is judged in S14 that the count value of the counter Y is greater than the set value that indicates the duration of the ready mode (S14: YES), the CPU 210 instructs the counter Z to start counting (S21). Then, the CPU 210 sets the value FU to "0" and performs the fixing temperature control operation (S22). As a result, "0" is stored in the fixing temperature mode storage area 212*g* and the application of a voltage to the halogen lamp 41*a* of the fixing device 18 is stopped. That is, the printer enters the sleep mode, in which it waits for reception of print data with the fixing device 18 turned completely off, that is, the fixing device 18 is no longer preheated. Then, the CPU 210 executes the "fan control process" subroutine (S23) represented by the flowchart shown in FIG. 10 to set the rotation speed of each fan as appropriate for the sleep mode, that is, set the rotation of the sub-fan 118 to middle speed and the power supply fan 120 and the main fan 117 off. At this time, Fu is set at "0" as a result of the operation in S22 and the counting of the counter Z has already been started, so that the operations in S61, S62, S63, S64, and S66 in the fan control process subroutine in FIG. 10 are performed in this order. As a result, SF is set at "1" and PF and MF are retained at the value of "0" that was set in S61. Then, the fan drive process of S74 is performed and the sub-fan 118 is driven to rotate at middle speed and the power supply fan 120 and the main fan 117 are each stopped.

Next, after returning to the fan control main routine shown in FIG. 8, the CPU 210 confirms whether print data has been received (S24). Similarly to the operation in S13 described above, the CPU 210 confirms whether the ASIC 215 has received print data. When no print data has been received by the ASIC 215 (S24: NO), the CPU 210 confirms whether Z is greater than "1200" (S25). When the value in the counter Z storage area 212*b* of the RAM 212 is equal to or less than "1200" (S25: NO), the process returns to S24, thereby repeating the judgment operations in S24 and S25.

When it is confirmed in S24 that the ASIC 215 has received print data (S24: YES), the CPU 210 executes the print process subroutine in S5 in the manner represented by the flowchart of FIG. 9, so that the laser printer 1 enters the print mode and printing is started. When printing is finished, the process returns to the fan control main routine shown in FIG. 8, thereby performing the operations in S11 and the succeeding steps. The laser printer 1 enters the ready mode after printing is finished.

When it is judged in S25 that the count value of the counter Z is greater than "1200" (S25: YES), that is, when 1200 seconds (20 minutes) have elapsed since the laser printer 1 entered the sleep mode, the CPU 210 sets the values X, Y, and Z to "0" (S31). As a result, "0" is stored in each of the counter X storage area 212*a*, the counter Y storage area 212*b*, and the counter Z storage area 212*c* of the RAM 212. Then, the CPU 210 executes the "fan control process" subroutine (S32) as represented in the flowchart of FIG. 10. Because Fu was set at "0" in S22, the operations in S61, S62, and S64 in the fan control process subroutine in FIG. 10 are performed in this order and SF, PF, and MF are all set to "0". Then, the fan drive process of S74 is performed, so that the sub-fan 118, the power supply fan 120, and the main fan 117 are each stopped.

Next, after returning to the fan control main routine shown in FIG. 8, the CPU 210 confirms whether print data has been received (S33). That is, the CPU 210 confirms whether the ASIC 215 has received print data and, when no print data has been received by the ASIC 215 (S33: NO), continues the operation for confirming whether print data has been received. Then, when the ASIC 215 has received print data (S33: YES), the CPU 210 executes the print process subroutine in S5 represented in the flowchart of FIG. 9. As a result, the laser printer 1 enters the print mode and starts printing. When printing is finished, the process returns to the fan control main routine of FIG. 8 and the operations in S11 and the succeeding steps are performed, so that the laser printer 1 enters the ready mode after printing is finished.

Figure 11:
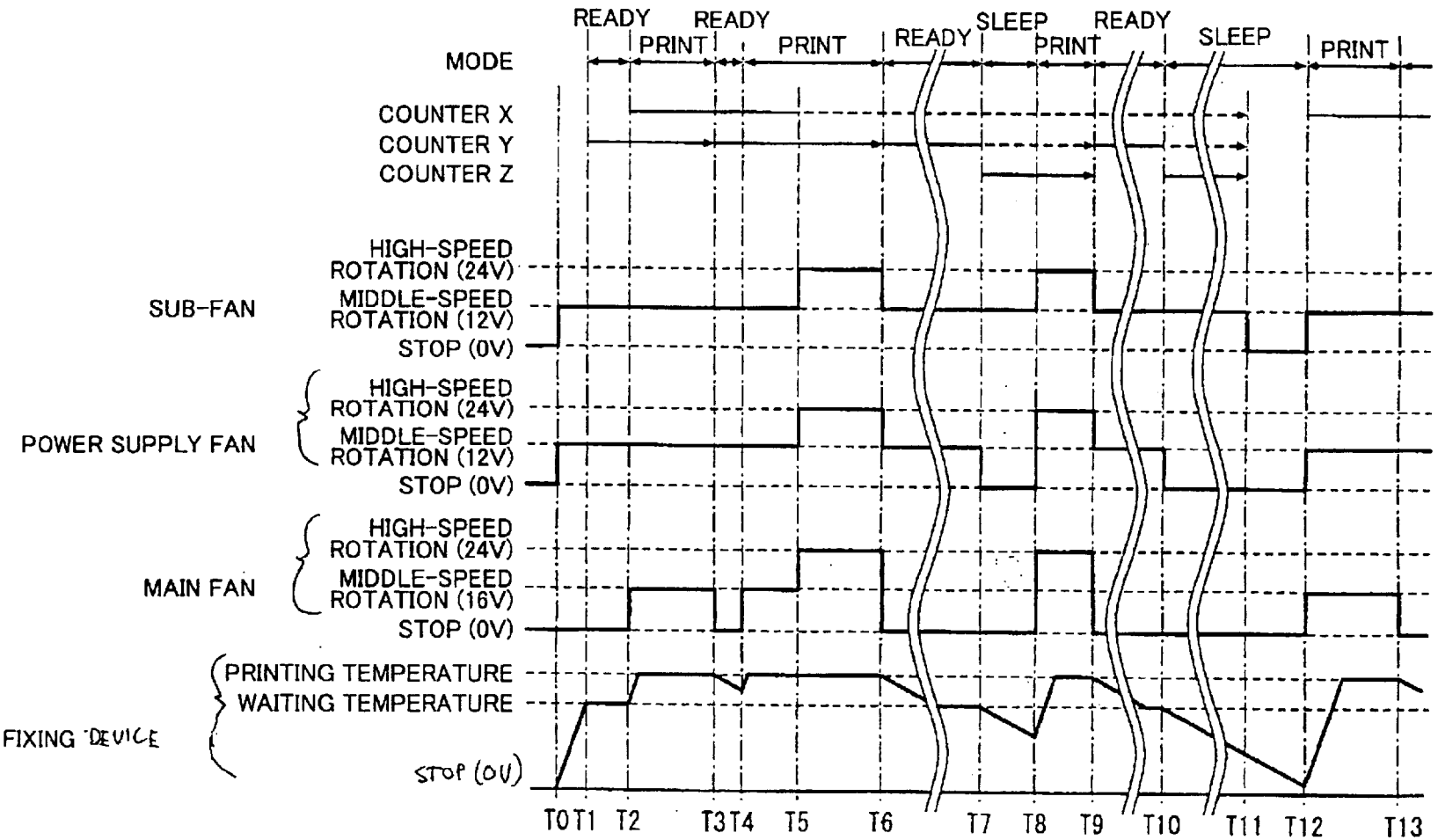
FIG. 11 is a timing chart showing an example of drive control of the fans.

Next, an example of timings, at which the driving of each fan is controlled, will be described with reference to FIGS. 8 to 11. FIG. 11 is a timing chart showing examples of the drive control of each fan.

At timing T0 shown in FIG. 11, the laser printer 1 is turned on and a voltage for heating the fixing device 18 to the waiting temperature is first applied to the halogen lamp 41*a* in S2 in FIG. 8. Next, the operation in S3 is performed, so that the sub-fan 118 and the power supply fan 120 are each driven to rotate at middle speed. Then, between the timings T0 and T1, the operations in S4 and S5 are repeated until the temperature of the fixing device 18 reaches the waiting temperature.

Next, at the timing T1, the operations in S11 and S12 are performed so that the counter Y starts counting, the laser printer 1 enters the ready mode, and the operations in S13 and S14 are repeated from the timing T1. Then, at timing T2, the CPU 210 detects that the ASIC 215 has received print data. Therefore, the print process in S5 is performed, so that the laser printer 1 enters the print mode and printing is started. The counter X starts counting at the timing T2 because this print process is being performed for the first time after the power of the printer 1 was turned on. Also, the halogen lamp 41*a* is applied with a voltage to bring the temperature of the fixing device 18 to the printing temperature. Further, the sub-fan 118, the power supply fan 120, and the main fan 117 are each driven to rotate at middle speed. Note that 240 seconds from timing T2 elapse at timing T5.

The print process in S5 finishes at timing T3, whereupon the laser printer 1 is set in the ready mode and the counter Y starts counting again. At the timing T3, 240 seconds have not yet elapsed from the timing T2 when the counter X started counting, so that the sub-fan 118 and the power supply fan 120 are each maintained rotating at middle speed and the main fan 117 is stopped as a result of the fan control process in S12. Also, the halogen lamp 41*a* is applied with a voltage to heat the fixing device 18 to the waiting temperature. The operations in S13 and S14 are repeated after timing T3. Then, at timing T4 before the counter Y reaches the set value, it is confirmed that the ASIC 215 has received print data. Therefore, the CPU 210 performs the print process in S5 so that the laser printer 1 enters the print mode and printing is started.

During the print process shown in FIG. 9, the count value of the counter X exceeds "240" at the timing T5, so that the process proceeds from the judgment operation in S52 to the operation in S54, in which the fan control process is performed. Because the laser printer 1 is set in the print mode and the count value of the counter X is equal to or greater than "240" seconds at the timing T5, the sub-fan 118, the power supply fan 120, and the main fan 117 are each driven to rotate at high speed. Then, at timing T6, the print process of the laser printer 1 is finished.

At the timing T6, the print process in S5 is finished, so that the laser printer 1 is set in the ready mode and the counter Y is reset and restarts counting at S11. Then, the sub-fan 118 and the power supply fan 120 are each driven to rotate at middle speed and the main fan 117 is stopped as a result of the fan control process in S12. After timing T6, the CPU 210 does not detect reception of print data by the ASIC 215 before the count value of the counter Y reaches the set value stored in the counter set value storage area 217*a* of the flash RAM 217 at timing T7. Therefore, the printer 1 is switched from the ready mode to the sleep mode and the counter Z starts counting as a result of the operation in S21. Also, voltage application to the halogen lamp 41*a* of the fixing device 18 is stopped at S22. Further, the fan control process is performed in S23, so that the sub-fan 118 is driven to rotate at middle speed, and the power supply fan 120 and the main fan 117 are each stopped.

The laser printer 1 is set in the sleep mode after timing T7, so that the operations in S24 and S25 are repeated. At timing T8, the CPU 210 confirms that the ASIC 215 received print data during the sleep mode, so that the print process in S5 is performed, the laser printer 1 is set in the print mode, and printing is started. Because the counter X was still not reset, the mode of each fan at this point in time is maintained the same as that at the timing T5, so that the sub-fan 118, the power supply fan 120, and the main fan 117 are each driven to rotate at high speed.

Then, the print process of the laser printer 1 is finished at timing T9, so that the laser printer 1 enters the ready mode like at the timing T6. That is, as a result of the operations in S11 and S12, the sub-fan 118 and the power supply fan 120 are each driven to rotate at middle speed, the main fan 117 is stopped, and a voltage is applied to the halogen lamp 41*a* to heat the fixing device 18 to the waiting temperature. Note that at timing T7, the count value of the counter Y exceeds the set value that indicates the duration of the ready mode (S14: YES) and the counter Z starts counting (S21). However, the laser printer 1 enters the print mode at the timing T8 before the count value of the counter Z exceeds 1200. The counter Z continues counting until the print mode is finished at the timing T9.

At timing T10, the count value of the counter Y reaches the set value that indicates the duration of the ready mode. As a result, the laser printer 1 enters the sleep mode and the counter Z is started counting in S21. Also, application of voltage to the halogen lamp 41*a* of the fixing device 18 is stopped in S22. Further, the fan control process is performed in S23, so that the sub-fan 118 is driven to rotate at middle speed and the power supply fan 120 and the main fan 117 are each stopped.

Next, the counter Z exceeds the predetermined value of 1200 at timing T11, so that each of the counters X, Y, and Z are reset to "0" in S31. Also, the fan control operation in S32 is performed so that the sub-fan 118, the power supply fan 120, and the main fan 117 are each stopped. The sleep mode is continued by repeating the judgment operation in S33 until timing T12 at which the CPU 210 confirms that print data has been received by the ASIC 215. At timing T12, the laser printer 1 enters the print mode. Because the count value of the counter X was reset to "0" at timing T11, the counter X starts counting from zero again at timing T12 while the sub-fan 118, the power supply fan 120, and the main fan 117 are each driven to rotate at middle speed. Then, after the print process is finished at timing T13, the process returns to the operation in S11 and the control of each fan is performed from then on in the manner described above.

According to the laser printer 1 of the first embodiment, after power is turned on or during a predetermined time period from the start of a print process performed for the first time after resetting (before four minutes have elapsed in the embodiment), the heat generated from the fixing device 18, the low-voltage power supply unit 90, and the like will not influence on the toner in the process cartridge 17. Therefore, the sub-fan 118, the power supply fan 120, and the main fan 117 are each driven to rotate at middle speed, which makes it possible to reduce noise ascribable to wind noise of the fans. Also, noise can be reduced by controlling the rotation speed of each fan even when no print process is performed. Also, during the print mode, the CPU 210 sets the temperature of the fixing device 18 to a temperature at which printing is performed. During the ready mode, the CPU 210 sets the temperature of the fixing device 18 to a lower temperature than the print temperature. As a result, there is a transition from the ready mode to the print mode that makes it easy to perform the control for setting the temperature of the fixing device 18 at the temperature at which printing is performed, in comparison with a case where there is performed transition from the sleep mode to the print mode directly.

Next, a laser printer according to a second embodiment will be described with reference to FIGS. 12 to 14. The laser printer of the second embodiment has basically the same configuration as the laser printer 1 of the first embodiment. Therefore, the following explanation will use the same reference numbers to indicate similar components and will focus on different aspects of the laser printer of the second embodiment.

Figure 12:
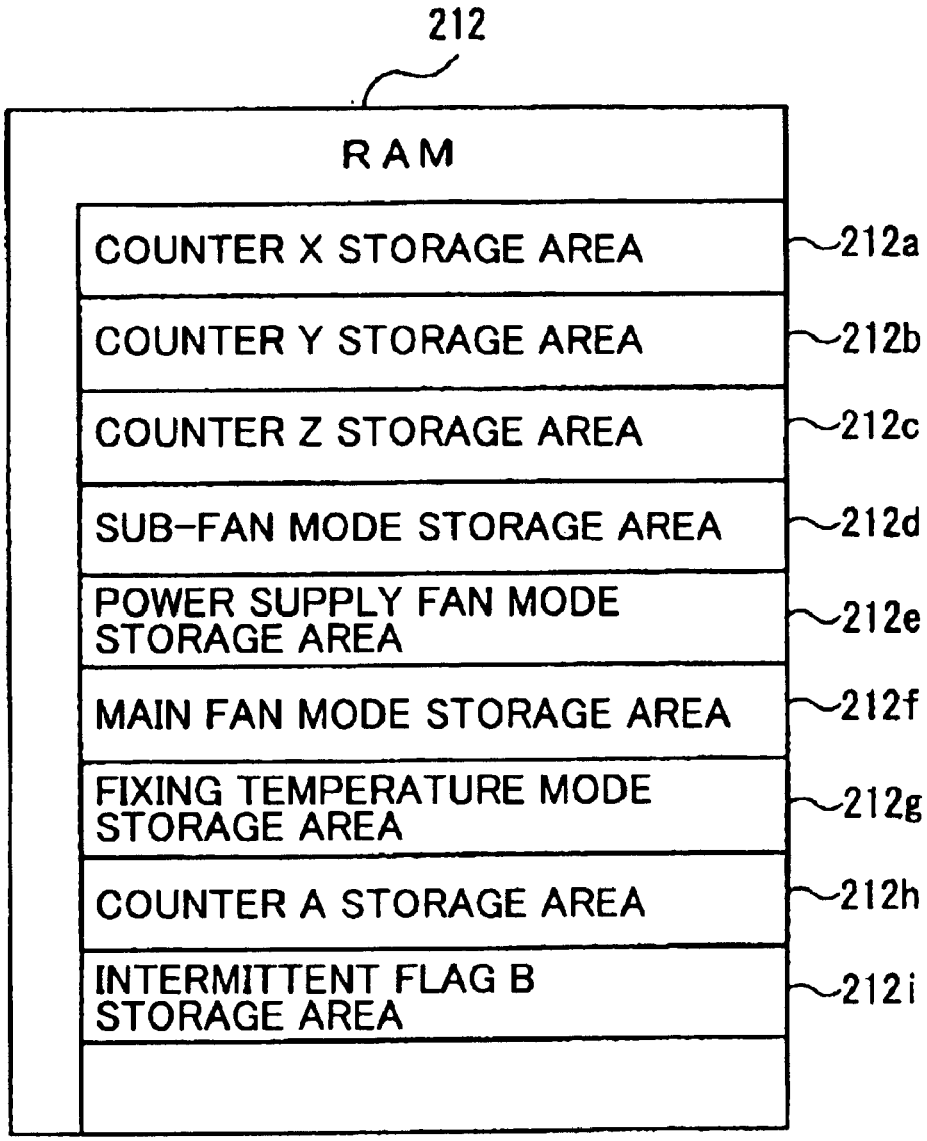
FIG. 12 is a schematic diagram representing storage areas of a RAM of a second embodiment.

FIG. 12 is a schematic diagram showing a storage area of the RAM 212 according the second embodiment. Like the laser printer 1 of the first embodiment, the laser printer of the second embodiment possesses a print mode in which printing is performed, a ready mode in which there is waited for reception of print data under a state where the fixing device 18 is controlled to assume the waiting temperature, and a sleep mode in which there is waited for reception of print data while the fixing device 18 is turned off (i.e., preheating is stopped). In the laser printer of the second embodiment, an intermittent fan control is performed during the ready mode.

As shown in FIG. 12, in addition to the construction of the storage area of the RAM 212 of the first embodiment, the RAM 212 of the laser printer of the second embodiment is provided with a counter A storage area 212*h* and an intermittent flag B storage area 212*i*. In the counter A storage area 212*h*, there is stored the count value of a counter A. Also, in the intermittent flag B storage area 212*i*, there is stored a flag that is set to either a value of "0" or "1" for determining which of the main fan 117 and the power supply fan 120 are to be driven during the intermittent fan control to be described later.

In each of the sub-fan mode storage area 212*d*, the power supply fan mode storage area 212*e*, and the main fan mode storage area 212*f*, there is stored a value ("0", "1", or "2") of corresponding one of the variables SF, PF, and MF. The variable values are referred to when control of each fan is performed while an intermittent fan control program to be described later is being executed. Also, the drive circuit 220 (see FIG. 4) applies a drive voltage to each fan so that the fan is stopped when its corresponding variable value is "0", is driven to rotate at middle speed when the variable value is "1", and is driven to rotate at high speed when the variable value is "2".

It should be noted here that when the sub-fan 118, the power supply fan 120, and the main fan 117 are driven to rotate at high speed, a voltage of 24 V is applied from the drive circuit 220 to each fan. Also, when these fans are driven to rotate at middle speed, a voltage of 12 V is applied to the sub-fan 118 and the power supply fan 120 and a voltage of 16 V is applied to the main fan 117. Further, in the laser printer of the second embodiment, during the intermittent fan control, the high-speed rotation is not selected as the drive speed of any fan.

The counter A is a counter for measuring elapsed time in order to judge whether a predetermined condition (whether the main fan 117 has been driven for 60 seconds or the power supply fan 120 has been driven for 840 seconds) is met during the ready mode of the laser printer of the second embodiment. The counter A starts counting when the laser printer of the second embodiment enters the ready mode and is incremented by one each time one second elapses. Also, once a print process that started during counting by the counter A is finished or after the counter A exceeds a predetermined value (900 in this example), the counter A is cleared to "0" and restarts counting from "0". The intermittent fan control is ended when the counter Y reaches the set value.

Next, control of the main fan 117, the sub-fan 118, and the power supply fan 120 in the laser printer of the second embodiment will be described by following flowcharts shown in FIGS. 13 and 14. FIG. 13 is a flowchart of an intermittent fan control main routine of the second embodiment. FIG. 14 is a flowchart of an intermittent fan control process subroutine. The flowcharts of the intermittent fan control shown in FIGS. 13 and 14 are carried out through execution of the program stored in the fan control program storage area 211*a* of the ROM 211 by the CPU 210, as is the case of the first embodiment. The program is started when the laser printer of the second embodiment is turned on.

Figure 13:
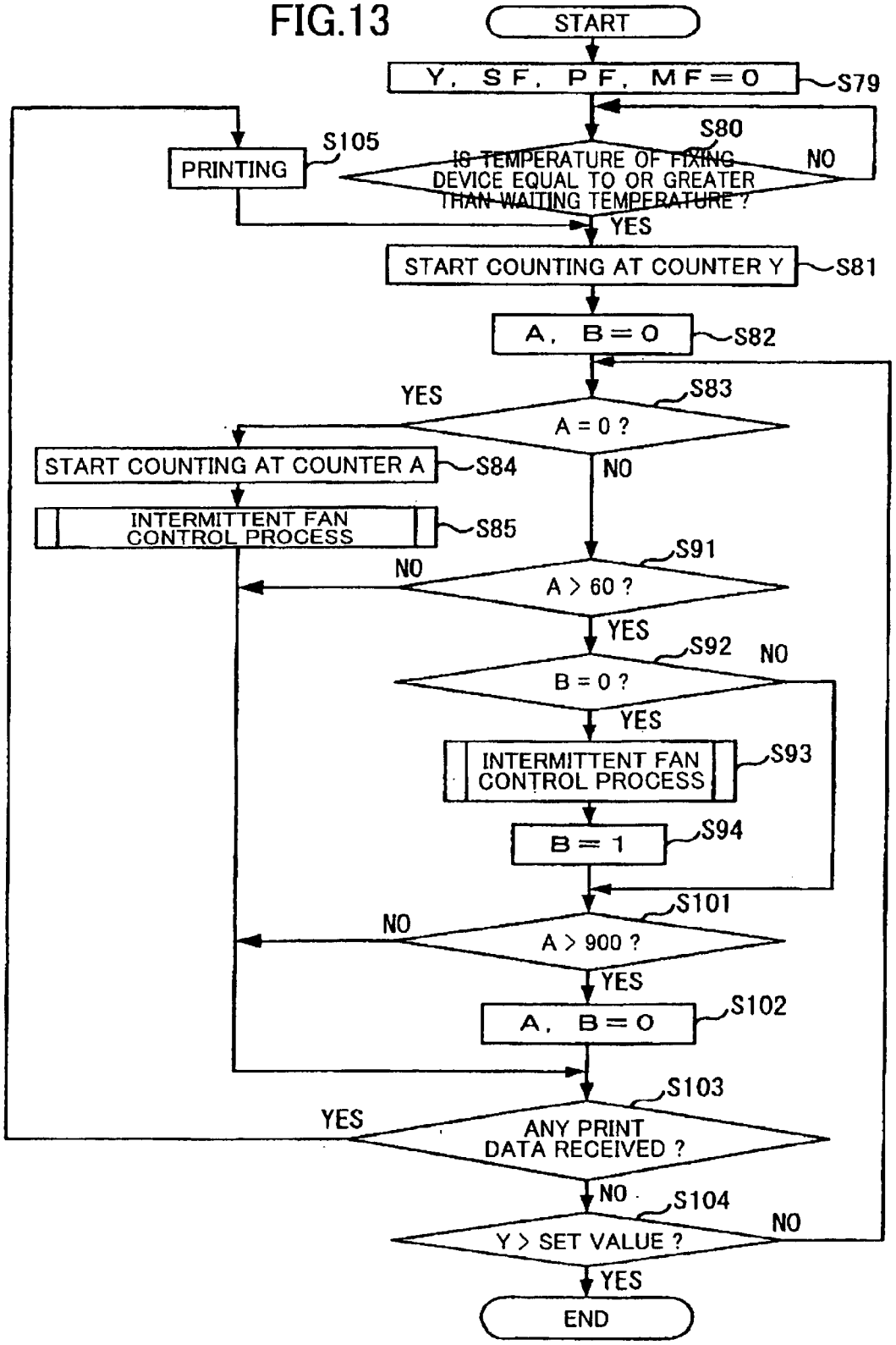
FIG. 13 is a flowchart representing an intermittent fan control main routine of the second embodiment.

As shown in FIG. 13, when the intermittent fan control program is executed, the CPU 210 first sets the values Y, SF, PF, and MF to "0" (S79), thereby storing "0" in each of the counter Y storage area 212*b*, the sub-fan mode storage area 212*d*, the power supply fan mode storage area 212*e*, and the main fan mode storage area 212*f* of the RAM 212. The CPU 210 then confirms whether the temperature of the fixing device is equal to or greater than the waiting temperature (S80). That is, by utilizing the temperature sensor (not shown), the CPU 210 confirms whether the temperature of the fixing device 18 resulting from the application of a voltage from the drive circuit 221 to the halogen lamp 41*a* has reached the waiting temperature. The CPU 210 refrains (S80: NO) from advancing the process until the temperature of the fixing device 18 reaches the waiting temperature (S80: YES), whereupon the CPU 210 proceeds to the operation in S81. Note that in this embodiment, control of the temperature of the fixing device 18 is performed by another program.

Then the CPU 210 instructs the counter Y to start counting (S81), thereby starting the ready mode in which the laser printer of the second embodiment waits for reception of print data. The CPU 210 then sets the value A and B to "0" (S82), thereby storing "0" in each of the counter A storage area 212*h* and the intermittent flag B storage area 212*i* of the RAM 212.

Next, the CPU 210 judges whether A is set at "0" by referring to the value in the counter A storage area 212*h* (S83). If it is found that the count value of the counter A is "0" (S83: YES), the CPU 210 instructs the counter A to start counting (S84) and executes the "intermittent fan control process" subroutine in order to set the rotation speed of each fan (S85). As a result, the process in the flowchart shown in FIG. 14 is performed.

Figure 14:
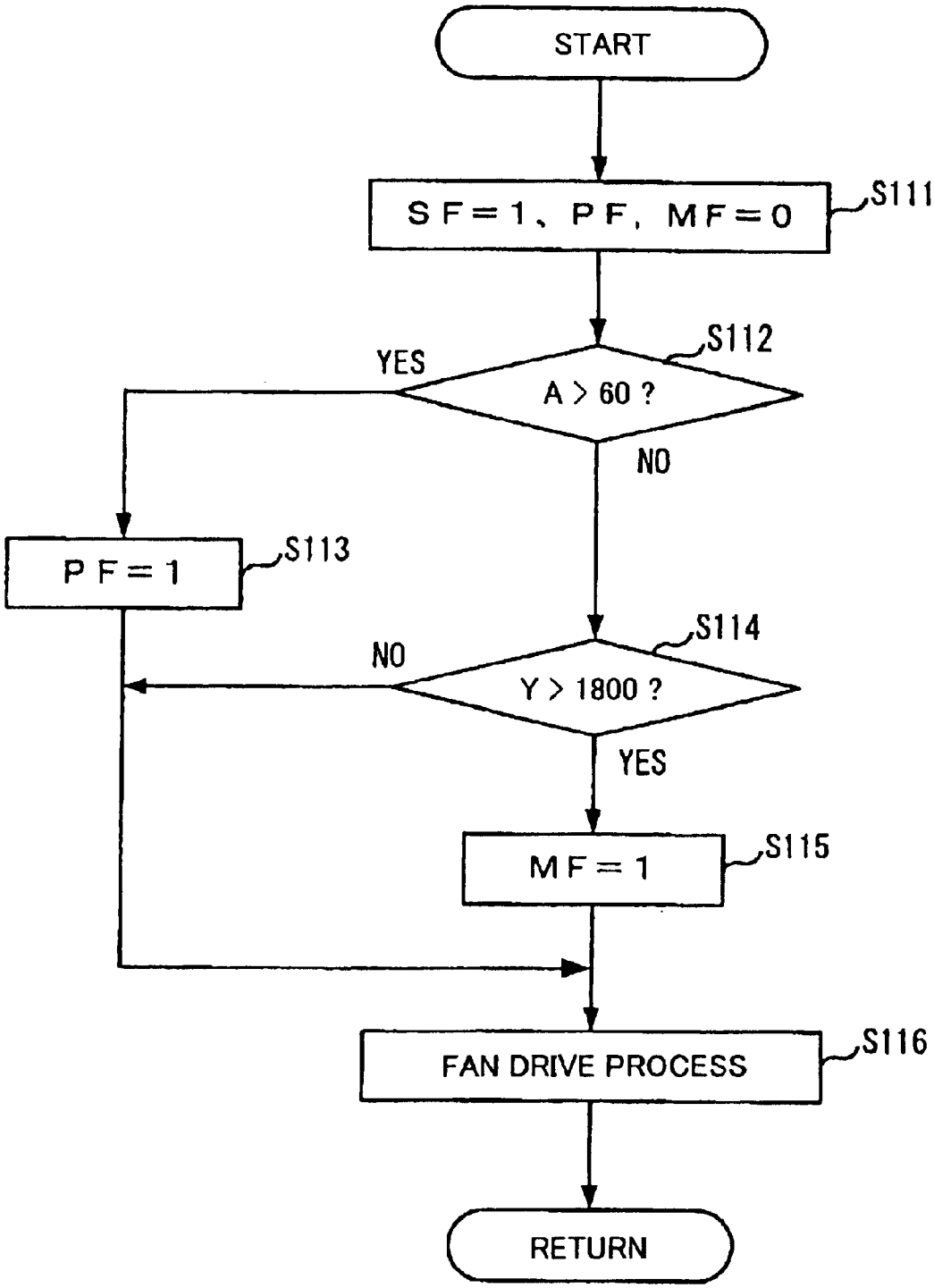
FIG. 14 is a flowchart representing an intermittent fan control process subroutine.

As shown in FIG. 14, after the intermittent fan control process subroutine is started, SF is set to "1" and PF and MF are each set to "0" (S111), so that "1" is stored in the sub-fan mode storage area 212*d* of the RAM 212 and "0" is stored in each of the power supply fan mode storage area 212*e* and the main fan mode storage area 212*f*. As a result of this operation, an initial value for the operation of each fan is set in order to determine the operation of each fan based on various conditions during the fan control process.

Next, in order to confirm whether A is greater than "60" (S112), the CPU 210 refers to the value in the counter A storage area 212*h* of the RAM 212. In this example, the operation of S112 is being performed immediately after the counter A started counting in S84, so that the count value of the counter A is equal to or less than "60" (S112: NO). As a result, the CPU 210 confirms whether Y is greater than "1800" (S114). In this example, the operation of S114 is being performed immediately after the counter Y started counting as a result of the operation in S81 in FIG. 13, so that the count value of the counter Y is still equal to or less than "1800" (S114: NO). The CPU 210 then performs the "fan drive process" (S116). In this example, the process proceeded to S112 and then to S114 after SF was set at "1" and each of PF and MF were set at "0" as a result of the operation in S111. Therefore, none of the fan mode values are changed during the fan drive process in S116. As a result, a drive voltage is applied from the drive circuit 220 so that the sub-fan 118 is driven to rotate at middle speed and the power supply fan 120 and the main fan 117 are each stopped. Thereafter, the process returns to the intermittent fan control main routine shown in FIG. 13.

It should be noted here that when it is found in S112 that the count value of the counter A is greater than "60" (S112: YES), that is, when 60 seconds have elapsed from the start of counting by the counter A, PF is set at "1" (S113). As a result, "1" is stored in the power supply fan mode storage area 212*e* of the RAM 212. Then, the fan drive process is performed based on the values SF and PF being at "1" and the value MF being at "0" (S116), so that the sub-fan 118 and the power supply fan 120 are each driven to rotate at middle speed and the main fan 117 is stopped. Thereafter, the process returns to the intermittent fan control main routine shown in FIG. 13.

Also, even when the count value of the counter A is smaller than "60", when it is found in S114 that the count value of the counter Y is greater than "1800" (S112: NO, S114: YES), that is, when 1800 seconds (30 minutes) have elapsed after the counter Y started counting, MF is set at "1" (S115). As a result, "1" is stored in the main fan mode storage area 212*f* of the RAM 212. Then, the fan drive process is performed based on the values SF and MF being at "1" and the value PF being at "0" (S116), so that the sub-fan 118 and the main fan 117 are each driven to rotate at middle speed and the power supply fan 120 is stopped. Thereafter, the process returns to the intermittent fan control main routine shown in FIG. 13.

As shown in FIG. 13, after returning from the intermittent fan control process subroutine in S85, the CPU 210 confirms whether print data has been received (S103). As is the case of the first embodiment, the CPU 210 confirms whether the ASIC 215 has received print data and, when the ASIC 215 has received the print data (S103: YES), the CPU 210 performs a "print" process (S105). During the print process, each fan is placed under an operation state at the time of printing and is driven to rotate at middle speed. Then, when the print process is finished, the count value of the counter Y is reset and the process returns to the operation in S81.

When no print data has been received by the ASIC 215 (S103: NO), the CPU 210 then confirms whether Y is greater than the set value (S104). That is, the CPU 210 compares the set value stored in the counter set value storage area 217*a* of the flash RAM 217 with the value in the counter Y storage area 212*b* of the RAM 212. When the count value of the counter Y is equal to or smaller than the set value (S104: NO), the process returns to S83. On the other hand, when the count value of the counter Y is greater than the set value (S104: YES), the present intermittent fan control is ended because the time period set for the ready mode by the set value has elapsed. Therefore, the laser printer of the second embodiment enters the sleep mode. Note that the control of each fan during the sleep mode is the same as that in the first embodiment. That is, only the sub-fan 118 is driven to rotate at middle speed before 1200 seconds (20 minutes) elapses from the start of the sleep mode as long as no print data is received. All fans are stopped after 1200 seconds elapses.

When it is found as a result of the judgment operation in S104 that the count value of the counter Y is equal to or less than the set value (S104: NO), the process returns to S83, in which the count value of the counter A is referred to. In this example, the process in S84 has already been performed and the counter A has already started counting (S83: NO), so the process proceeds to S91. Then, the CPU 210 confirms whether A is greater than "60" (S91) by referring to the count value of the counter A in the same manner as above. When 60 seconds have not yet elapsed after the start of counting by the counter A, the process proceeds to S103 (S91: NO). As a result, unless there is satisfied a condition such as the reception of print data or the counter Y reaching the set value, the operations in S103, S104, S83, and S91 are repeated.

Then, when the count value of the counter A becomes greater than "60" (S91: YES), in order to confirm whether B is equal to "0" (S92), the CPU 210 refers to the value in the intermittent flag B storage area 212*i* of the RAM 212. When the count value of the counter A becomes greater than "60" for the first time, the intermittent flag B is set at "0" as a result of the operation in S82 (S92: YES), so that the "intermittent fan control process" subroutine is executed (S93) and the process in the flowchart shown in FIG. 14 is performed. In this example, it is found in S112 that the count value of the counter A is greater than "60" (S112: YES), so that the values SF and PF are set to "1" and the value MF is set to "0", that is, the sub-fan 118 and the power supply fan 120 are each driven to rotate at middle speed and the main fan 117 is stopped.

Next, after returning to the intermittent fan control main routine shown in FIG. 13, the CPU 210 sets the value B to "1" (S94), thereby storing "1" in the intermittent flag B storage area 212*i* of the RAM 212. The CPU 210 then confirms whether A is greater than "900" (S101). When the count value of the counter A is equal to or smaller than "900" (S101: NO), the CPU 210 next performs operations in S103 and S104, thereby returning to the operation in S83 unless print data is received or the counter Y exceeds the set value.

During the judgment operation in S92 in this example, the value of the intermittent flag B was set at "1" in S94 when the process was previously performed (S92: NO), so that the process proceeds to S101 this time. In this manner, the intermittent flag B insures that the intermittent fan control process subroutine is executed only a single time each time the counter A exceeds 60 seconds, which means that the power supply fan 120 has been stopped for 60 seconds.

Then, when the count value of the counter A exceeds "900" (S101: YES), the CPU 210 sets A and B to "0" (S102), so that "0" is stored in each of the counter A storage area 212*h* and the intermittent flag B storage area 212*i* of the RAM 212. Further, unless a condition, such as the reception of print data or the counter Y exceeding the set value, is satisfied, the CPU 210 returns to the operation in S83.

Figure 15:
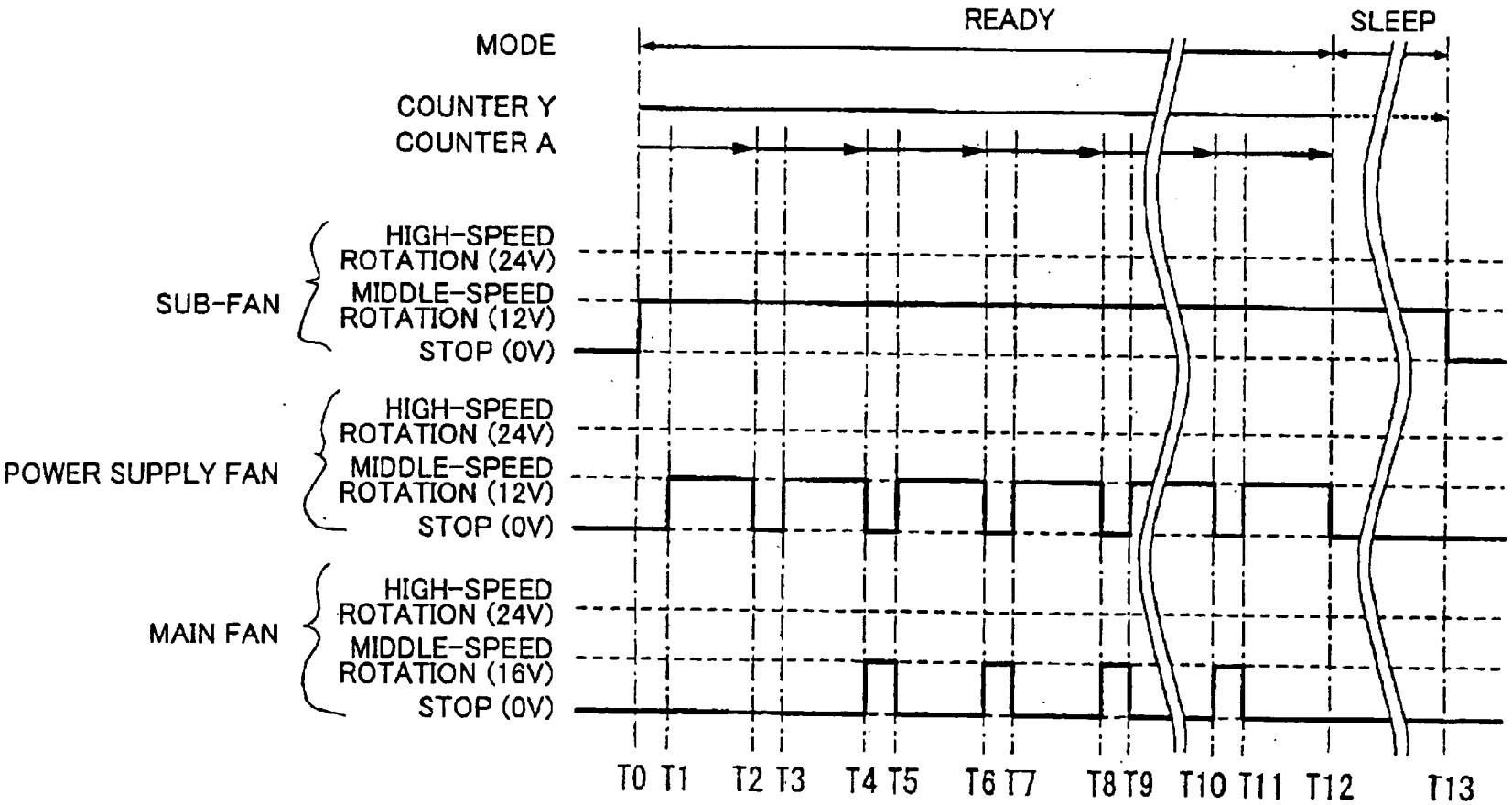
FIG. 15 is a timing chart showing an example of drive control of the fans according to the second embodiment.

Next, an example of timings at which the driving of each fan is controlled in the laser printer of the second embodiment will be described with reference to FIGS. 13 to 15. FIG. 15 is an example of a timing chart of the drive control of each fan.

As shown in FIG. 15, the laser printer of the second embodiment enters the ready mode at timing T0. At this time, the temperature of the fixing device 18 is at the waiting temperature. Also at timing T0, the counter Y starts counting at timing T0 as a result of the operation in S81 in FIG. 13. Substantially at the same time, the counter A is reset to zero in S82, so that the process proceeds to S83 and S84, whereupon the counter A starts counting. When the intermittent fan control process in S85 is performed at timing T0, the count value of the counter A is equal to or smaller than "60" and the count value of the counter Y is equal to or smaller than "1800", so that only the sub-fan 118 is driven to rotate at middle speed.

Next, the operations in S83, S91, S103, and S104 are repeated until 60 seconds have elapsed from the timing T0. As a result, the count value of the counter A becomes greater than "60", so that the process proceeds from the judgment operation in S91 to S92 at timing T1. At timing T1, the value of the intermittent flag B is still set at "0" from the process in S82 (S92: NO), so the intermittent fan control process in S93 is carried but. During the intermittent fan control process, the count value of the counter A is greater than "60", so that PF is set to "1", whereupon the sub-fan 118 and the power supply fan 120 are each driven to rotate at middle speed as a result of the fan drive process in S116. Then, the value of the intermittent flag B is set at "1" in S94, so that the operations in S83, S91, S92, S101, S103, and S104 are repeated after the timing T1. At timing T2, 900 seconds (15 minutes) have elapsed from timing T0, so that the count value of the counter A becomes greater than "900". Therefore, the process proceeds from the judgment operation in S101 to S102.

Also at timing T2, the counter A and the intermittent flag B are reset to zero in S102, so that the process proceeds from the operation in S83 to the operations in S84 and S85. When the intermittent fan control process is performed in S85 this time, the count value of the counter A is equal to or less than "60" and the count value of the counter Y is equal to or smaller than "1800" as is the case of the timing T1. Therefore, when the fan drive process of S116 is performed, the power supply fan 120 is turned off and only the sub-fan 118 is driven to rotate at middle speed. Then, at timing T3, an operation using the same judgment condition as at the timing T1 is performed, so that both power supply fan 120 is turned back on and both the power supply fan 120 and the sub-fan 118 are driven to rotate at middle speed.

At timing T4, 900 seconds (15 minutes) have elapsed from the timing T2 and the count value of the counter A becomes greater than "900", so that as is the case of the timing T2, the counter A and the intermittent flag B are reset to zero in S102 after S101. Therefore, the operations in S83 and S84 are performed and the process proceeds to the operation in S85. During the intermittent fan control process in S85 this time, the count value of the counter A is equal to or smaller than "60" as is the case of the timing T1. However, 1800 seconds (30 minutes) have elapsed from the timing T0 so the count value of the counter Y is greater than "1800". Therefore, when the fan drive process of S116 is performed, the power supply fan 120 is turned off and the sub-fan 118 and the main fan 117 are each driven to rotate at middle speed.

Following this, the operations in S83, S91, S103, and S104 are repeated. At timing T5, 60 seconds have elapsed from the timing T4 so that the count value of the counter A is greater than "60". Therefore, the operations in S91 and S92 are performed and the intermittent fan control process subroutine in S93 is executed. During execution of the intermittent fan control process subroutine this time, the operations in S111, S112, S113, and S116 in FIG. 14 are performed, so that the main fan 117 is turned off and the sub-fan 118 and the power supply fan 120 are both driven to rotate at middle speed. After that, the operations in S83, S91, S92, S101, S103, and S104 are repeated until timing T6 at which 900 seconds (15 minutes) have elapsed from the timing T4.

Following this, the same intermittent fan control process as at the timings T4 to T6 is repeated during each time period from timings T6 to T8, from timings T8 to T10, and from timings T10 to T12, so that the power supply fan 120 and the main fan 117 are alternately driven to rotate at middle speed: the power supply fan 120 being driven for 60 seconds each time and the main fan 117 being driven for 840 seconds (14 minutes) each time.

Then, at the timing T12, a predetermined time period has elapsed from the timing T0 so that the count value of the counter Y exceeds the set value stored in the counter set value storage area 217*a*. Therefore, the laser printer of the second embodiment exits the ready mode and the present intermittent fan control is ended. Note that during the time period from the timing T12 to timing T13, the laser printer of the second embodiment is set in the sleep mode so that only the sub-fan 118 is driven to rotate at middle speed.

According to the laser printer of the second embodiment, the power supply fan 120 and the main fan 117 are alternately driven during the ready mode while reception of print data is awaited, which makes it possible to reduce the noise ascribable to the wind noise of the fans.

Also, the CPU 210 operates some of the plurality of fans while stopping others, with their operation states being alternately changed each time certain times elapse. As a result, it becomes possible to reduce the noise ascribable to the wind noise of the fans.

Also, the CPU 210 alternately changes the operation states of the fans until the reception of print data or during a predetermined time period after a print process is ended. As a result, it becomes possible to reduce the noise ascribable to the wind noise of the fans.

Also, while the sub-fan operates, the CPU 210 also operates one of the power supply fan and the main fan and stops the other, so that their operation states are alternately interchanged each time the predetermined time period has elapsed. As a result, it becomes possible to reduce the noise ascribable to the wind noise of the fans.

While the invention has been described in detail with reference to the specific embodiments thereof, it would be apparent to those skilled in the art that various changes and modifications may be made therein without departing from the spirit of the invention.

For instance, the laser printer 1 of the first embodiment may be modified so that the intermittent fan control of the laser printer of the second embodiment is performed during the ready mode. In this case, the operations in S81 to S104 in FIG. 13 are carried out in place of the operations in S11 to S14 in FIG. 8. Also, the print process subroutine shown in FIG. 9 is executed during the "print" process in S105. This enables the intermittent fan control process to be implemented in the laser printer 1 of the first embodiment. With this configuration, the CPU 210 alternately changes the operation states of the fans after setting the temperature of the fixing device 18 to a lower temperature than the printing temperature. As a result, it becomes possible to reduce the noise ascribable to the wind noise of the fans. Also, from a first timing when the fixing device 18 is set to a predetermined temperature that is lower than a temperature at which printing is performed, the CPU 210 operates the sub-fan while repeatedly turning the power supply fan on and off, that is, while operating the power supply fan for a predetermined time period after stopping the power supply fan for a predetermined time period. From a second timing at which a predetermined time period elapses from the first timing, the CPU 210 stops the main fan while operating the power supply fan, and operates the main fan while stopping the power supply fan. At a third timing at which a predetermined time period has elapsed from the first timing, the CPU 210 stops the fixing device 18, the power supply fan, and the main fan. At a fourth timing at which a predetermined time period has elapsed from the third timing, the CPU 210 stops the sub-fan as well. As a result, it becomes possible to reduce the noise ascribable to the wind noise of the fans.

Also, the laser printer 1 of the first embodiment may be modified so that during the sleep mode, the sub-fan 118 and the power supply fan 120 are continuously driven to rotate at middle speed and the main fan 117 stopped as long as four minutes have not yet elapsed from the start of the counter X.

As described above, the user can select the duration of the ready mode within a range from 1 minute to 40 minutes. Therefore, there is a possibility that the laser printer 1 might enter the sleep mode before four minutes have elapsed from the start of the first printing operation. If the laser printer 1 enters the sleep mode so soon after a printing operation, there is a danger that heat generated from the fixing device 18, the low-voltage power supply unit 90, and the like might influence the process cartridge 17. However, the above-described modification reduces the possibility of such influence. To implement this modification, an additional judgment of "X>240?" is added after a "NO" judgment in S63 of FIG. 10. That is, the CPU 210 judges whether X is greater than "240" by referring to the value in the counter X storage area 212*a* in a manner similar to S71. Also, if the count value of the counter X is greater than "240" (i.e., a "YES" judgment), then the process advances to S64. On the other hand, if the count value of the counter X is equal to or less than "240" (i.e., a "NO" judgment), then the process proceeds to S65.

Also, the printers of the first and second embodiments may be modified so that the count values counted up by the counters X, Z, and A are also optionally settable, not just the count value of the counter Y.

Also, the first embodiment describes the counter X as being started counting at the start of the print process subroutine of FIG. 9, which is executed when the CPU 210 confirms that the ASIC 215 has received print data. However, the counter X may start counting when some other predetermined condition is satisfied, such as when the print data received by the ASIC 215 is processed and expanded into printable data, when the temperature of the fixing device 18 reaches the printing temperature, or when sheet feeding is started.

Also, the embodiment described that the counter Y starts counting each time the fixing temperature reaches the waiting temperature after the laser printer 1 is turned on or a print process in the laser printer 1 is finished. However, the counting by the counter Y may be started each time some other predetermined condition is satisfied, such as when the main motor (not shown) of the laser printer 1 is stopped or when a predetermined time period elapses after the fixing device 18 reaches the waiting temperature.

Also, the actual rotation speeds during the high-speed rotation and the middle-speed rotation of each fan may be optionally settable by the user.

Also, the fans need not be started at the same timing during the fan drive process in S74 of the fan control process subroutine of FIG. 10. That is, each fan may be started at an optionally different timing.

Also, the embodiments describe rotation speed of each fan as being selected from two speeds, that is, the high speed and middle speed. However, the rotation speed may be selectable from three or more speeds.

In this way, it can be predicted that the temperature within the main case of the printer will be sufficiently cool for a predetermined duration of time (240 seconds in the embodiment) after a predetermined condition of either a power switch turning on supply of power to the image forming section 5 or after the count value of the Z counter exceeds 1200. This predetermined duration of time can be referred to as a "cool" time period, and is predetermined. The CPU 210 controls the fans at the slow rotation speed during a print process performed during a "cool" time period. As a result, even during a print process, it is possible to reduce noise ascribable to wind noise of the fans.

Also, the CPU 210 controls the fans at the fast rotation speed after the "cool" time period has elapsed. As a result, after the "cool" time period has elapsed during the print process, it is possible to enhance the cooling effect by increasing the volume of airflow generated by the fans.

Further, the CPU 210 controls to stop the fans or drive them at the slow rotation speed when it is predicted that the process cartridge 17 arranged in the vicinity of the fixing device 18 will not influenced by heat propagated from the fixing device 18 after the start of the print process. When it is predicted that the process cartridge 17 will be influenced by the heat, then each of the fans is drive at the fast rotation speed. As a result, it becomes possible to reduce the noise ascribable to the wind noise of the fans while preventing the influence of the heat on the process cartridge 17.

Still further, the CPU 210 controls the fans to either stop of rotate at the slow rotation speed when, after the start of the print process, it is predicted that the low-voltage power supply unit 90 for supplying electric power to the process cartridge 17 and the fixing device 18 will not influenced by heat generated by the low-voltage power supply unit 90. When it is predicted that the low-voltage power supply unit 90 will be influenced by the heat, then the fans are driven at the fast rotation speed. As a result, it becomes possible to reduce the noise ascribable to the wind noise of the fans while preventing the influence of the heat on the low-voltage power supply unit 90.

Also, the power supply fan cools the low-voltage power supply unit 90, the sub-fan cools the fixing device 18, and the main fan cools the low-voltage power supply unit 90, the fixing device 18, and the process cartridge 17. As a result, each of the low-voltage power supply unit 90, the fixing device 18, and the process cartridge 17 can be efficiently cooled.

Also, the noise ascribable to the wind noise of the fans can be reduced during the "cool" time period from the start of a print process performed for the first time after power-on or from reset of the X counter.

Also, the CPU 210 drives the sub-fan and the power supply fan at the slow rotation speed and stops the main fan during the ready mode, which starts upon finishing of a print process and which ends either after the predetermined time period or when print data is received. As a result, it becomes possible to reduce the noise ascribable to the wind noise of the fans.

Also, during the ready mode period, the CPU 210 repeatedly stops the power supply fan for a predetermined time period after driving the power supply fan at the slow rotation speed for a predetermined time period. As a result, it becomes possible to reduce the noise ascribable to the wind noise of the fans.

Also, the CPU 210 stops the main fan when the power supply fan operates at the slow rotation speed, and operates the main fan at the slow rotation speed when the power supply fan is stopped. As a result, it becomes possible to reduce the noise ascribable to the wind noise of the fans.

Also, the CPU 210 starts a sleep mode when no print data is received during the ready mode and ends the sleep mode either after passage of a predetermined time period or when print data is received. The CPU 210 operates the sub-fan at the slow rotation speed and stops the power supply fan and the main fan during the sleep mode. As a result, it becomes possible to reduce the noise ascribable to the wind noise of the fans.

What is claimed is:

1. An image forming apparatus comprising:

a main body case defining therein an inner space;

an image forming unit that is disposed in the inner space and that performs image forming processes, the image forming unit forming an image on a sheet during each image forming process;

a fan for cooling the image forming unit, the fan being capable of operating selectively in a first rotation speed, a second rotation speed, and a stopped state, the fan rotating faster in the first rotation speed of the fan than in the second rotation speed of the fan and not rotating in the stopped state;

a condition-determining unit that determines whether a predetermined condition is met;

a fan controller that controls the fan at the second rotation speed when the image forming unit performs an image forming process during a predetermined time period after the condition-determining unit determines that the predetermined condition is met;

an electric power switch that turns on and off supply of electric power to the image forming unit; and a timer that measures whether a predetermined cooling interval has elapsed after the image forming unit completes an image forming process, the predetermined condition being start of a first image forming operation after at least one of the electric power switch turning on supply of electric power to the image forming unit and the timer measuring that the predetermined cooling interval has elapsed.

2. The image forming apparatus as claimed in claim 1, wherein the fan controller controls the fan at the first rotation speed while the image forming unit performs an image forming process after the predetermined time period.

3. The image forming apparatus as claimed in claim 1, wherein the image forming unit includes:

a process unit for transferring a developer image onto the sheet; and a fixing unit that generates heat for thermally fixing the developer image transferred by the process unit onto the sheet, the fixing unit being disposed in the vicinity of the process unit, wherein the condition-determining unit determines a timing when, after the image forming unit starts an image forming process, heat from the fixing unit will increase temperature in the vicinity of the process unit sufficient to adversely influence the process unit and the fan controller controls to drive the fan in one of the stopped state and the second rotation speed before the timing and in the first rotation speed from the timing.

4. The image forming apparatus as claimed in claim 3, wherein the condition-determining unit determines that heat from the fixing unit will not adversely influence the process unit before the timing.

5. The image forming apparatus as claimed in claim 1, further comprising a power supply unit for supplying electric power to the image forming unit during an image forming process, wherein the condition-determining unit determines a timing when, after the image forming unit starts an image forming process, heat from the power supply unit will adversely influence the power supply unit, the fan controller controlling to drive the fan in one of the stopped state and the second rotation speed before the timing and in the first rotation speed from the timing.

6. The image forming apparatus as claimed in claim 5, wherein the condition-determining unit determines that heat from the power supply unit will not adversely influence the power supply unit before the timing.

7. The image forming apparatus as claimed in claim 5, further comprising:

a process unit for transferring a developer image onto a sheet; and a fixing unit that generates heat for thermally fixing the developer image transferred by the process unit onto the sheet, the fixing unit being disposed in the vicinity of the process unit, the power supply unit supplying electric power to the process unit and the fixing unit while the image forming unit performs an image forming process.

8. The image forming apparatus as claimed in claim 1, wherein the image forming unit includes:

a process unit for transferring a developer image onto the sheet; and a fixing unit that generates heat for thermally fixing the developer image transferred by the process unit onto the sheet, the fixing unit being disposed in the vicinity of the process unit, and further comprising:

a power supply unit for supplying electric power to the process unit and the fixing unit, wherein the fan includes a power supply fan for cooling the power supply unit, a sub-fan for cooling the fixing unit, and a main fan for cooling the power supply unit, the fixing unit, and the process unit.

9. The image forming apparatus as claimed in claim 8, further comprising:

a data reception unit that receives data used by the image forming unit to form images; and a ready mode setting unit that sets a ready mode each time the image forming unit finishes an image forming process and stops the ready mode after one of passage of a predetermined ready-mode time period after the image forming process and reception of data by the data reception unit for a new image forming process, the fan controller controlling the sub-fan and the power supply fan in the second rotation speed and the main fan in the stopped state during the ready mode.

10. The image forming apparatus as claimed in claim 9, further comprising a sleep mode setting unit that sets a sleep mode when the data reception unit receives no print data during the predetermined ready-mode time period of the ready mode and that ends the sleep mode upon one of passage of a predetermined sleep-mode period after the ready mode and reception of print data by the data reception unit for starting a new image forming process, the fan controller controlling the sub-fan at the second rotation speed and the power supply fan and the main fan in the stopped state during the sleep mode.

11. The image forming apparatus as claimed in claim 8, further comprising:

a data reception unit that receives data used by the image forming unit to form images; and a ready mode setting unit that sets a ready mode each time the image forming unit finishes an image forming process and stops the ready mode after one of passage of a predetermined ready-mode time period after the image forming process and reception of data by the data reception unit for a new image forming process, wherein during the ready mode the fan controller controls the power supply fan alternately between the stopped state and the second rotation speed.

12. The image forming apparatus as claimed in claim 11, wherein during the ready mode the fan controller controls the main fan in the stopped state while controlling to drive the power supply fan at the second rotation speed and the main fan at the second rotation speed while controlling the power supply fan in the stopped state.

13. An image forming apparatus comprising:

a main body case defining therein an inner space;

an image forming unit that is disposed in the inner space and that performs image forming processes, the image forming unit forming an image on a sheet during each image forming process;

a fan for cooling the image forming unit, the fan being capable of operating selectively in a first rotation speed, a second rotation speed, and a stopped state, the fan rotating faster in the first rotation speed of the fan than in the second rotation speed of the fan and not rotating in the stopped state;

a temperature-prediction unit that predicts when a temperature in the inner space of the main body case will be below a predetermined temperature; and a fan controller that controls the fan at the second rotation speed while the image forming unit performs an image forming process within a predetermined period of time that begins from start of a first image forming operation after the temperature-prediction unit predicts that the temperature in the inner space of the main body case will be below a predetermined temperature.

14. The image forming apparatus as claimed in claim 13, further comprising:

an electric power switch that turns on and off supply of electric power to the image forming unit; and a timer that measures whether a predetermined cooling interval has elapsed after the image forming unit completes the image forming process, wherein the temperature-prediction unit predicts that the temperature in the inner space of the main body case will be below the predetermined temperature when at least one of:

the electric power switch turns on the supply of the electric power to the image forming unit, and the timer measures that the predetermined cooling interval has elapsed.

15. An image forming apparatus, comprising:

a main case that defines therein an inner space;

an image forming unit that is disposed in the inner space and that performs image forming processes, the image forming unit forming an image on a sheet during each image forming process;

a first fan and a second fan each of which rotates to cool the image forming unit in the inner space in the main case;

a fan controller that selectively drives the first fan and the second to rotate in alternation; and a data reception unit that receives data used by the image forming unit to form images, the fan controller selectively driving the first fan and the second fan to rotate in alternation from completion of an image forming process until one of a predetermined time period elapses and the data reception unit receives data for a new image forming process.

16. An image forming apparatus, comprising:

a main case that defines therein an inner space;

an image forming unit that is disposed in the inner space and that performs image forming processes, the image forming unit forming an image on a sheet during each image forming process;

a first fan and a second fan each of which rotates to cool the image forming unit in the inner space in the main case;

a fan controller that selectively drives the first fan and the second to rotate in alternation;

a process unit for transferring a developer image onto the sheet;

a fixing unit that generates heat for thermally fixing the developer image transferred by the process unit onto the sheet, the fixing unit being disposed in the vicinity of the process unit; and a fixing temperature control unit that controls temperature of the fixing unit selectively to a first temperature for fixing images and a second temperature that is lower than the first temperature, the fan controller selectively driving the first fan and the second fan to rotate in alternation when the fixing temperature control unit controls the temperature of the fixing unit to the second temperature.

17. An image forming apparatus, comprising:

a main case that defines therein an inner space;

an image forming unit that is disposed in the inner space and that performs image forming processes, the image forming unit forming an image on a sheet during each image forming process;

a first fan and a second fan each of which rotates to cool the image forming unit in the inner space in the main case;

a fan controller that selectively drives the first fan and the second to rotate in alternation;

a process unit for transferring a developer image onto a sheet;

a fixing unit that generates heat for thermally fixing the developer image transferred by the process unit onto the sheet, the fixing unit being disposed in the vicinity of the process unit;

a power supply unit for supplying electric power to the process unit and the fixing unit; and a sub-fan for cooling the fixing unit, wherein the first fan is a power supply fan for cooling the power supply unit and the second fan is a main fan for cooling the power supply unit, the fixing unit, and the process unit, the fan controller controlling the power supply fan and the main fan to rotate in alternation while controlling the sub fan to continuously operate.

18. An image forming apparatus, comprising:

a main case that defines therein an inner space;

an image forming unit that is disposed in the inner space and that performs image forming processes, the image forming unit forming an image on a sheet during each image forming process;

a first fan and a second fan each of which rotates to cool the image forming unit in the inner space in the main case; and a fan controller that selectively drives the first fan and the second to rotate in alternation;

wherein the fan controller selectively drives the first fan and the second fan to rotate in alternation each time a predetermined time period elapses.

19. An image forming apparatus comprising:

a process unit for forming a developer image with developer on a sheet;

a fixing unit for fixing the developer image transferred by the process unit onto the sheet;

a power supply unit for supplying electric power to the process unit and the fixing unit;

a power supply fan for cooling the power supply unit;

a sub-fan for cooling the fixing unit;

a main fan for cooling the power supply unit, the fixing unit, and the process unit;

a fixing temperature control unit that controls temperature of the fixing unit selectively to a first temperature for fixing images and a second temperature that is lower than the first temperature;

a fan controller for independently controlling a rotation speed of each of the power supply fan, the sub-fan, and the main fan; and a timing judger that judges:

a first timing when the fixing temperature setting unit sets temperature of the fixing unit to the second temperature, the fan controller controlling the sub-fan to rotate and the power supply fan to alternately rotate and not rotate from the first timing, a second timing at which a first predetermined time period elapses from the first timing, the fan controller stopping the main fan while rotating the power supply fan and rotating the main fan while stopping the power supply fan at the second timing, a third timing at which a second predetermined time period elapses from the first timing, the fixing temperature control unit turning the fixing unit off from the third timing and the fan controller stopping the power supply fan and the main fan from the third timing, and a fourth timing at which a third predetermined time period elapses from the third timing, the fan controller stopping the sub-fan from the fourth timing.

20. The image forming apparatus as claimed in claim 19, further comprising:

a data reception unit that receives print data used by the process unit to form the developer image;

a print mode setting unit that sets a print mode during which the process unit operates, the fixing temperature control unit controlling the fixing unit to the image fixing temperature during the print mode;

a ready mode setting unit that sets a ready mode at the first timing and ends the ready mode at one of the third timing and upon reception of print data at the data reception unit, the fixing temperature control unit controlling the fixing unit to the second temperature during the ready mode; and a sleep mode setting unit that sets a sleep mode at the third timing and ends the sleep mode upon reception of print data at the data reception unit, the fixing temperature control unit turning off the fixing unit during the sleep mode.

* * * * *